US012336581B2

(12) United States Patent
Lotti

(10) Patent No.: US 12,336,581 B2
(45) Date of Patent: Jun. 24, 2025

(54) PROSTHETIC EYELASH SYSTEM

(71) Applicant: Lashify, Inc., North Hollywood, CA (US)

(72) Inventor: Sahara Lotti, North Hollywood, CA (US)

(73) Assignee: Lashify, Inc., North Hollywood, CA (US)

( * ) Notice: Subject to any disclaimer, the term of this patent is extended or adjusted under 35 U.S.C. 154(b) by 166 days.

(21) Appl. No.: 17/674,570

(22) Filed: Feb. 17, 2022

(65) Prior Publication Data

US 2022/0279883 A1 Sep. 8, 2022

Related U.S. Application Data

(60) Provisional application No. 63/200,347, filed on Mar. 2, 2021.

(51) Int. Cl.
*A41G 5/02* (2006.01)

(52) U.S. Cl.
CPC ..... *A41G 5/02* (2013.01)

(58) Field of Classification Search
CPC ..... A41G 5/02; A45D 44/02
See application file for complete search history.

(56) References Cited

U.S. PATENT DOCUMENTS 2,079,256 A * 5/1937 Kaiser ..... A41G 5/02 132/53
3,266,500 A * 8/1966 Weld ..... A41G 5/02 132/320
4,029,111 A * 6/1977 Barton ..... A41G 5/02 132/53
8,061,367 B2 * 11/2011 Rabe ..... A41G 5/02 132/216
2009/0178689 A1 7/2009 Navarro et al.
2014/0135914 A1 * 5/2014 Conant ..... A41G 5/02 623/4.1
2018/0282595 A1 * 10/2018 Cruz ..... A61K 8/731
2019/0261715 A1 * 8/2019 Hunter ..... A61K 8/8152

FOREIGN PATENT DOCUMENTS

CN 111759038 A 10/2020
WO WO 02085186 * 10/2002
WO WO 2013109102 * 7/2013

OTHER PUBLICATIONS

Machine Translation of Ning et al. (Year: 2013).*
International Search Report and Written Opinion mailed on Jun. 8, 2022, on application No. PCT/US2022/016937.

* cited by examiner

*Primary Examiner* — Rachel R Steitz
*Assistant Examiner* — Karim Asqiriba
(74) *Attorney, Agent, or Firm* — Lowenstein Sandler LLP

(57) ABSTRACT

A prosthetic eyelash unit includes a base with a plurality of follicle areas located within the base. The prosthetic eyelash unit includes a plurality of artificial hairs extending from the plurality of follicle areas located within the base and through a front surface of the base. The base is designed to attach at least in part to a lash line of a user to form a prosthetic lash line.

20 Claims, 18 Drawing Sheets

PROSTHETIC EYELASH SYSTEM

RELATED APPLICATIONS

This application claims the benefit of U.S. Provisional Application No. 63/200,347, filed Mar. 2, 2021, the entire contents of which is incorporated by reference herein.

FIELD OF THE INVENTION

Embodiments of the disclosure relate generally to artificial eyelashes and, more specifically, prosthetic eyelashes and systems that can be applied to a user to replace lost natural lashes.

BACKGROUND

False eyelash extensions have conventionally been used to enhance the length, thickness, and fullness of natural eyelashes. Many false eyelash extensions are applied to an individual's natural eyelashes one by one to avoid having the eyelash extensions stick together. Other false eyelashes may be applied directly to an individual's eyelid. False eyelashes come in strips (and thus may also be referred to as "strip lashes") that can be trimmed to fit the width of the individual's eyelid. Rather than enhance a person's existing natural eyelashes many people would prefer to replace eyelashes lost though chemotherapy, burns, alopecia, or other conditions that cause the loss of eyelashes.

BRIEF DESCRIPTION OF THE DRAWINGS

The disclosure is illustrated by way of example, and not by way of limitation, in the figures of the accompanying drawings in which like references indicate similar elements. It should be noted that different references to "an" or "one" embodiment in this disclosure are not necessarily to the same embodiment, and such references mean at least one.

Figure 1A:
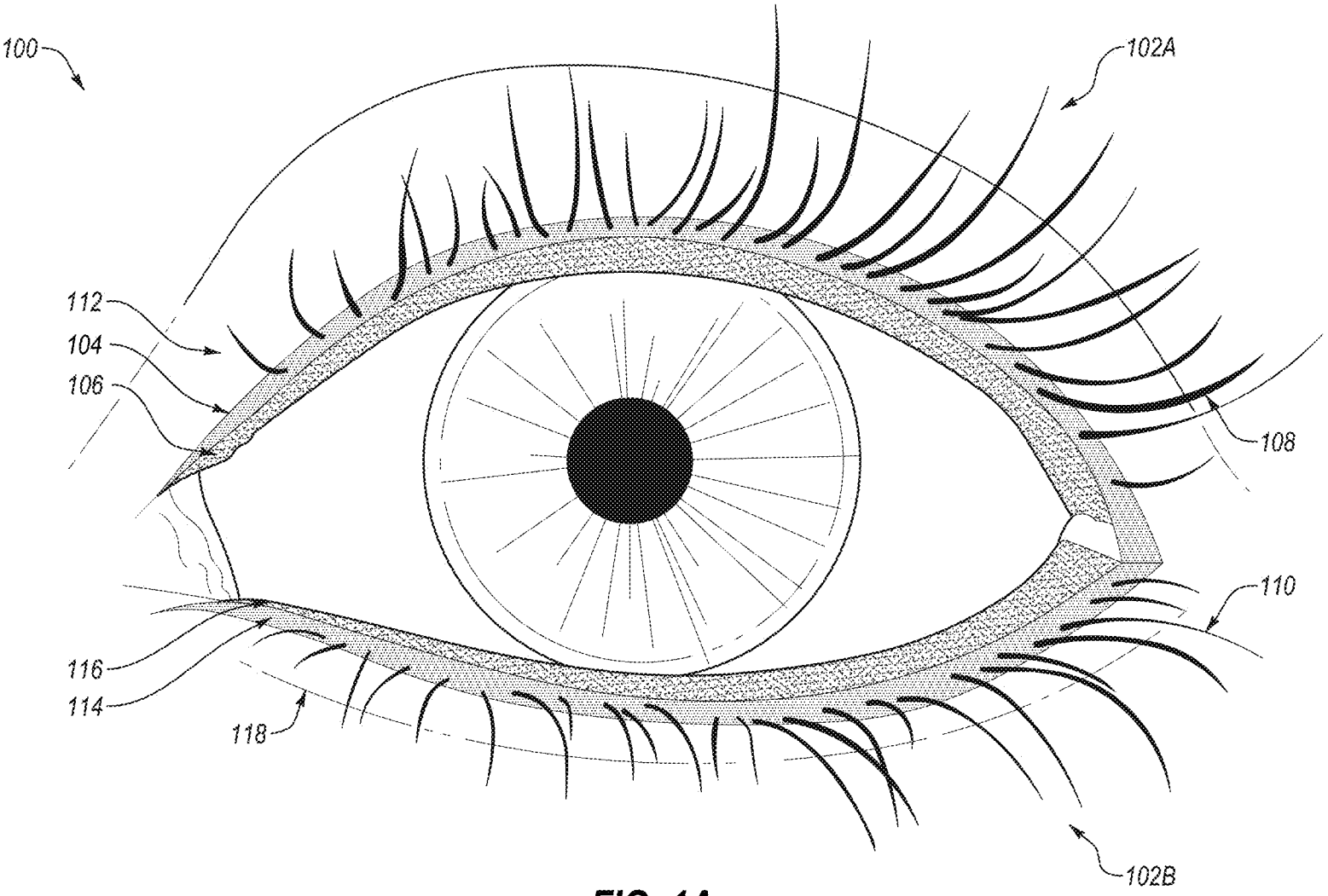
FIG. 1A is an illustration of a front view of an eye area, in accordance with some embodiments of the disclosure.

The figures depict various embodiments for the purpose of illustration only. Those skilled in the art will readily recognize that alternative embodiments may be employed without departing from the principles of disclosed herein.

BRIEF SUMMARY

According to some embodiments, disclosed herein is a prosthetic eyelash unit, comprising: a base comprising a plurality of follicle areas located within the base; and a plurality of artificial hairs extending from the plurality of follicle areas located within the base and through a front surface of the base, the base designed to attach at least in part to a lash line of a user to form a prosthetic lash line.

In some embodiments, the base comprises a first curvature that extends along a lengthwise side of the base, and wherein the base is formed at least in part of a flexible material that allows a rear surface of the base to bend between both lengthwise sides to form a second curvature that conforms to a shape of the lash line of the user.

In some embodiments, the plurality of follicle areas are positioned at different locations along the base, and wherein one to three artificial hairs of the plurality of artificial hairs extend from each of the plurality of follicle areas.

In some embodiments, the prosthetic eyelash unit further comprising: a plurality of prosthetic eyelash segments each comprising the base and the plurality of artificial hairs, the prosthetic eyelash segments designed to align adjacent to one another at the lash line of the user.

In some embodiments, the base further comprising: a lash line portion comprising the plurality of artificial hairs and designed to attach to the lash line of the user.

In some embodiments, the base further comprising: an eyelid portion monolithically coupled with the lash line portion, the eyelid portion designed to attach to a front surface of an eyelid of the user.

In some embodiments, the front surface of the base comprises an elongated shape defined by a colorant, the elongated shape configured to resemble eyeliner.

In some embodiments, an artificial hair of the plurality of artificial hairs comprises: a shaft; and a root area connected to the shaft, the root area to secure the artificial hair to the base.

In some embodiments, the root area of the artificial hair is located within the base or at a rear surface of the base.

In some embodiments, the flexible material of the base is a first material, the prosthetic eyelash unit further comprising: a hair attachment layer to which the plurality of artificial hairs are secured, the hair attachment layer comprising a second material different than the first material. In some embodiments, the hair attachment layer is embedded within the flexible material of the base. In some embodiments, the hair attachment layer is attached at the rear surface of the base.

In some embodiments, an adhesive layer coupled to a rear surface of the base. In some embodiments, the adhesive layer comprises a moisturizing component to moisturize skin at the lash line.

In some embodiments, the lash line of the user is an upper lash line. In some embodiments, the lash line of the user is a lower lash line.

In some embodiments, at least part of the front surface of the base comprises a skin-tone colorant.

In some embodiments, a depth of the base ranges between 0.1 millimeters to 0.9 millimeters.

In some embodiments, the flexible material of the base comprises silicone.

In some embodiments, the plurality of artificial hairs are attached to the base by an attachment process that pulls each of the plurality of artificial hairs through the base.

According to some embodiments, disclosed herein is a method of manufacturing a prosthetic eyelashes. In some embodiments, the base of the prosthetic eyelash is formed. In some embodiments, a colorant is added to the front surface of the base. In some embodiments, one or more artificial hairs are disposed through the base. In some embodiments, the root area of the one or more artificial hairs is formed. In some embodiments, the one or more artificial hairs of the prosthetic eyelashes are curled. In some embodiments, an adhesive layer is applied to the rear surface of the base. In some embodiments, the prosthetic eyelashes are affixed to a backing material.

According to some embodiments, disclosed herein are methods of manufacturing a prosthetic eyelashes. In some embodiments, the base of the prosthetic eyelash is formed. In some embodiments, a colorant is added to the front surface of the base. In some embodiments, a hair attachment layer is coupled to the base. In some embodiments, the artificial hairs are connected to the hair attachment layer. In some embodiments, the one or more artificial hairs of the prosthetic eyelashes are curled. In some embodiments, an adhesive layer is applied to the rear surface prosthetic eyelashes. In some embodiments, the prosthetic eyelashes are affixed to a backing material.

According to some embodiments, disclosed herein are methods of applying prosthetic eyelashes. In some embodiments, a first prosthetic eyelash segment is grasped. In some embodiments, an adhesive applied. In some embodiments, the first prosthetic eyelash segment is arranged at the lash line of the user. In some embodiments, the second prosthetic eyelash segment is grasped. In some embodiments, an adhesive is applied. In some embodiments, the second prosthetic eyelash segment is arranged at the lash line of the user. In some embodiments, the first and the second prosthetic eyelash segments are secured to the user.

Numerous other features are provided in accordance with these and other aspects of the disclosure. Other features and aspects of the present disclosure will become more fully apparent from the following detailed description, the claims, and the accompanying drawings.

DETAILED DESCRIPTION

Embodiments described herein are related to an apparatus, systems and methods for prosthetic eyelashes (also referred to as "prosthetic lashes" herein) that can be applied to a user to replace lost natural lashes.

Many individuals suffer from conditions that cause the individuals to lose their natural eyelashes. For example, many individuals lose their natural eyelashes due to chemotherapy, burns, alopecia, or other health or medical conditions that cause the loss of eyelashes. Some false eyelashes are applied on natural eyelashes and cannot be applied without natural eyelashes. Other false eyelashes may be applied to an individual's eyelids (e.g., strip lashes). However, such false eyelashes are cumbersome, bulky, uncomfortable and do not have a natural or realistic appearance that many individuals prefer.

To address the above and other challenges prosthetic eyelashes are disclosed herein. In some embodiments, the prosthetic eyelashes include a base (also referred to as a "prosthetic lash line" or "a part of a prosthetic eyelid" herein). The base can include or be formed from a flexible and/or elastic material. Multiple artificial hairs can extend from follicle areas within the base and through the front surface of the base. In some embodiments, the follicle areas are staggered along the prosthetic eyelashes (rather than positioned in a straight line) so that the prosthetic eyelashes appear more realistic. In some embodiments, at least part of the base (e.g., rear surface of the base) can attach to a lash line of a user using an adhesive material. In some embodiments, the base is designed to attach at least in part to a lash line of user to form a prosthetic lash line (e.g., is attached at least in part on the natural lash line of the user, such as on natural hair follicles where the natural lashes have been lost). In some embodiments, the prosthetic eyelashes can attach to the lash line of the user at least because the user has lost their natural eyelashes. Because of the absence of the natural eyelashes, the skin surface at the lash line is prepared for an application of prosthetic eyelashes that can adhere to the lash line with minimal to no interference from existing natural lashes. In some embodiments, a lash line, can also be referred to an eyelash follicle region. The lash line can include a part of the eye area that can include multiple hair follicles that may grow eyelashes.

In some embodiments, the base can also include a curve (also referred to as a "curvature" herein) that extends along the lengthwise side of the base. The curve that extends along the lengthwise side of the base can conform to the unique horizontal curvature of the lash line of a user.

In some embodiments, the flexible material of the base is designed to allow the rear surface of the prosthetic eyelashes bend between both lengthwise sides of the base to form another curve that conforms to the shape (e.g. vertical curvature) of the lash line or the transition between the lash line and the eyelid of the user. The flexible and/or elastic material can help the prosthetic eyelashes conform to the unique shape and curvature of the lash line and/or eyelid as well as adapt the prosthetic eyelashes to different shapes and dimensions of lash lines or eyelids of different users.

In some embodiments, the artificial hairs (also referred to as "artificial eyelashes" herein) are embedded within the base to appear like natural hairs growing out of the lash line. For example, the artificial lashes can extend through the front surface of the prosthetic eyelashes through follicle areas within the base. In some embodiments, a single artificial hair can extend from each follicle area to give the appearance of a natural lash line.

In some embodiments, the artificial hair can include a root area and a shaft. In some embodiments, the root area can have a diameter that is larger than the shaft to help secure the artificial hair in the base. For example, the artificial hair can be pulled though the base and knotted at the proximal end (e.g., nearest the rear surface of the prosthetic lash) to form a root area. In some embodiments, artificial hairs of prosthetic eyelashes can be secured to a hair attachment layer (e.g., woven, etc.) and the hair attachment layer can be embedded in or at the base.

In some embodiments, each of the prosthetic eyelashes include multiple prosthetic eyelash segments. Each prosthetic eyelash segment can include a base with one or more artificial hairs. The prosthetic eyelash segments can be arranged to align adjacent to one another, such as along the lash line and/or eyelid. In some cases, the use of prosthetic eyelash segments can allow the user more freedom of movement in the eye area and allow the prosthetic eyelashes to adhere to the user for a longer amount of time.

In some embodiments, some prosthetic eyelashes can be designed for the upper lashes and other prosthetic eyelashes can be designed for the lower lashes. For example, prosthetic eyelashes for the upper lash can have more hairs and have a different shape than prosthetic eyelashes for the lower lash. In some embodiments, some prosthetic eyelashes can be designed for the right lashes and other prosthetic eyelashes can be designed for the left lashes.

In some embodiments, the outer surface of the prosthetic eyelashes can include a skin-tone colorant to match or be similar to the skin tone of the user. In some embodiments, the prosthetic eyelashes can be produced to have a wide variety of skin-tone colors.

In some embodiments, the prosthetic eyelashes can also include colorant that is located in a position above, near or between the artificial hairs to mimic eyeliner or eye shadow.

Figure 1B:
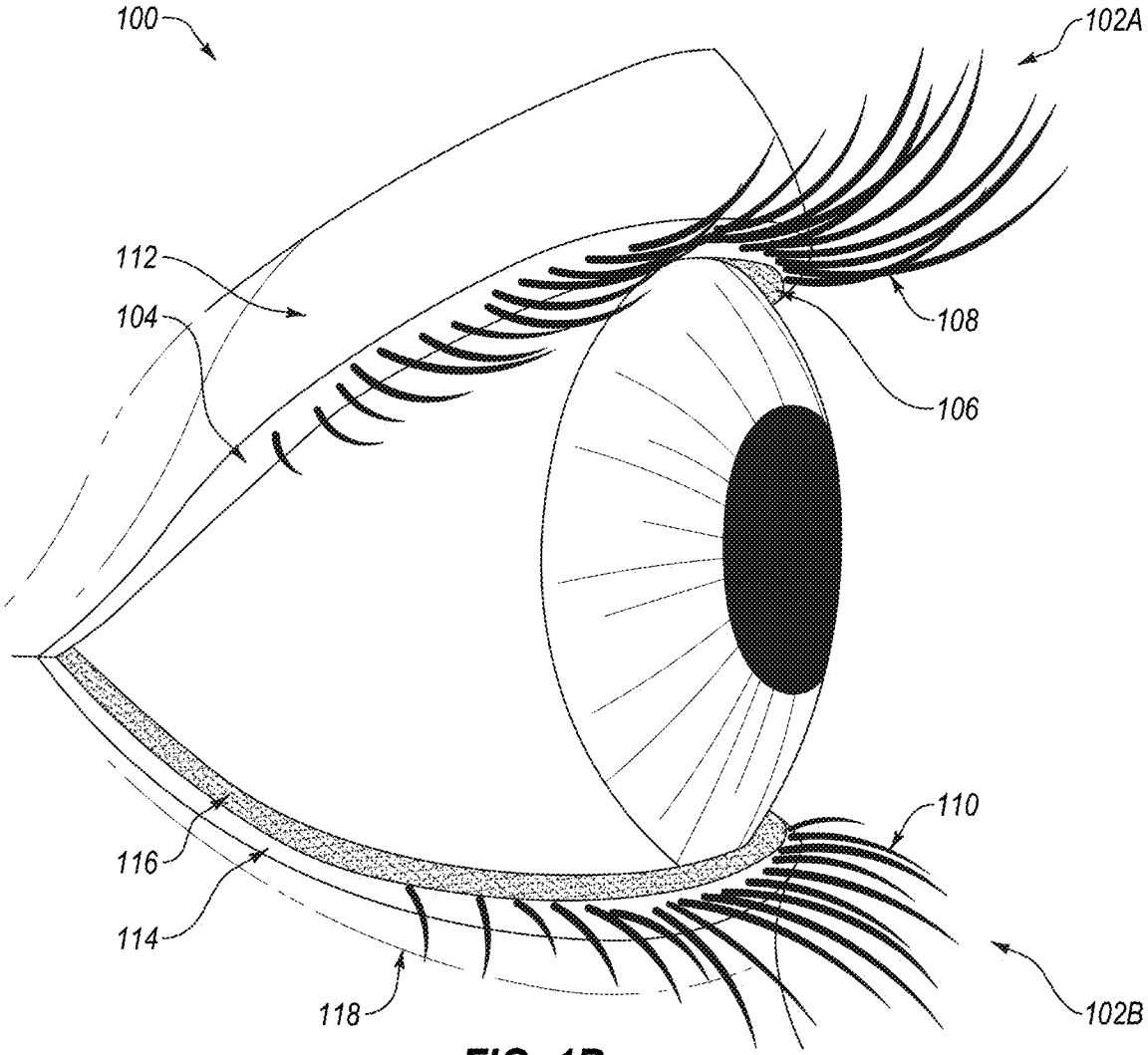
FIG. 1B is an illustration of a side view of an eye area, in accordance with some embodiments of the disclosure.

FIG. 1A is an illustration of a front view of an eye area, in accordance with some embodiments of the disclosure. FIG. 1B is an illustration of a side view of an eye area, in accordance with some embodiments of the disclosure. As shown in FIG. 1A-1B, the eye area 100, such as a human eye area, can include upper natural lashes 102A (also referred to as "natural lashes 102A" or "natural lash 102A" herein) and lower natural lashes 102B (also referred to as "natural lashes 102B" or "natural lash 102B" herein). Natural lashes 102A and 102B can have an underside and topside. For example, natural lashes 102A show an underside 108. The topside of natural lashes 102A face away from the eye and is opposite the underside 108. Natural lashes 102B show a topside 110. The underside of natural lashes 102B face away from the eye and is opposite the topside 110. Natural lashes 102A and 102B are generally referred to as natural lashes 102, herein. It can be noted that prosthetic eyelashes, as described herein, can include similar characteristics or features to natural lashes as described herein.

The eye area 100 includes an upper lash line 104 (also referred to as "lash line 104" or "eyelash follicle region 104" herein), upper waterline 106 (also referred to as "waterline 106" herein), and upper eyelid 112 (also referred to "eyelid 112" herein). The eye area 100 includes lower lash line 114 (also referred to as "lash line 114" or "eyelash follicle region 114" herein), lower waterline 116 (also referred to as "waterline 116" herein), and lower eyelid 118 (also referred to "eyelid 118" herein). It can be noted that in some embodiments, the eyelid 112 can refer more specifically to the front facing surface of the eyelid. It is appreciated that the lash line can be part of the eyelid, but at least in some embodiments, does not substantially include the front facing surface of the eyelid.

In some embodiments, a lash line, such as upper lash line 104 or lower lash line 114, can also be referred to an eyelash follicle region as noted above. The lash line 104 or lash line 114 can include multiple hair follicles that can grow eyelashes at the lash line. It can be noted that in some instances, as noted above, that some individuals may have eyelash loss at the lash line and/or are unable to grow eyelashes at the lash line. In such instances, the lash line is the same part of the eye area 100 as referenced herein. In some embodiments, a lash line, such as the upper lash line 104 or lower lash line 114, can include the area between the natural lashes (e.g., between the multiple hair follicles of the lash line). The lash line can be curved in the longitudinal direction (e.g., lengthwise) and follow the alignment of the natural lashes 102. The lash line can also be curved in a crosswise direction (e.g., a curve from the waterline to the eyelid). In some embodiments, the upper lash line 104 can include some area of the skin that is above (e.g., directly above) the natural lashes 102A. Similarly, the lower lash line 114 can include some area of the skin that is below (e.g., directly below) the natural lashes 102B.

In some embodiments, the waterline (also referred to as "wetline" herein), such as upper waterline 106 and lower waterline 116, can include an area (or line) of skin that is exposed between the natural lashes 102 (e.g., lash line) and the eye.

In some embodiments, the eyelid, such as upper eyelid 112 and lower eyelid 118 can refer to an area that is adjacent (e.g., directly adjacent) to a respective one of lash line 104 or lash line 114. The eyelid can be a fold of skin that can cover and protect the eye. In some embodiments, the surface of the eyelid and the surface of the lash line can point in different directions. For example, in a state when the eye is closed (e.g., eyelids are shut) the angle between a vector the is perpendicular to the surface of the eyelid (e.g., eyelid 112) and a vector that is perpendicular to the surface of the corresponding lash line (e.g., lash line 104) are at an appreciable angle, such as at an angle that is greater than 30 degrees and in some areas roughly 90 degrees.

Spatially relative terms, such as "under," "upper" "lower," "top," "bottom," "inner," "outer," and so forth as used herein refer to a relative position of one element with respect to another element. Unless otherwise specified, the spatially relative terms are not intended to be limiting to the absolute orientation, and are intended to encompass different orientations (e.g., rotated 90 degrees, inverted, flipped) of elements in addition to the orientation depicted in the Figures. For example, if elements in the Figures are inverted, elements described as "upper" elements can then be considered oriented as "lower" elements, and "lower" elements can be considered oriented as "upper" element, without deviating from aspects of the disclosure.

Figure 2A:
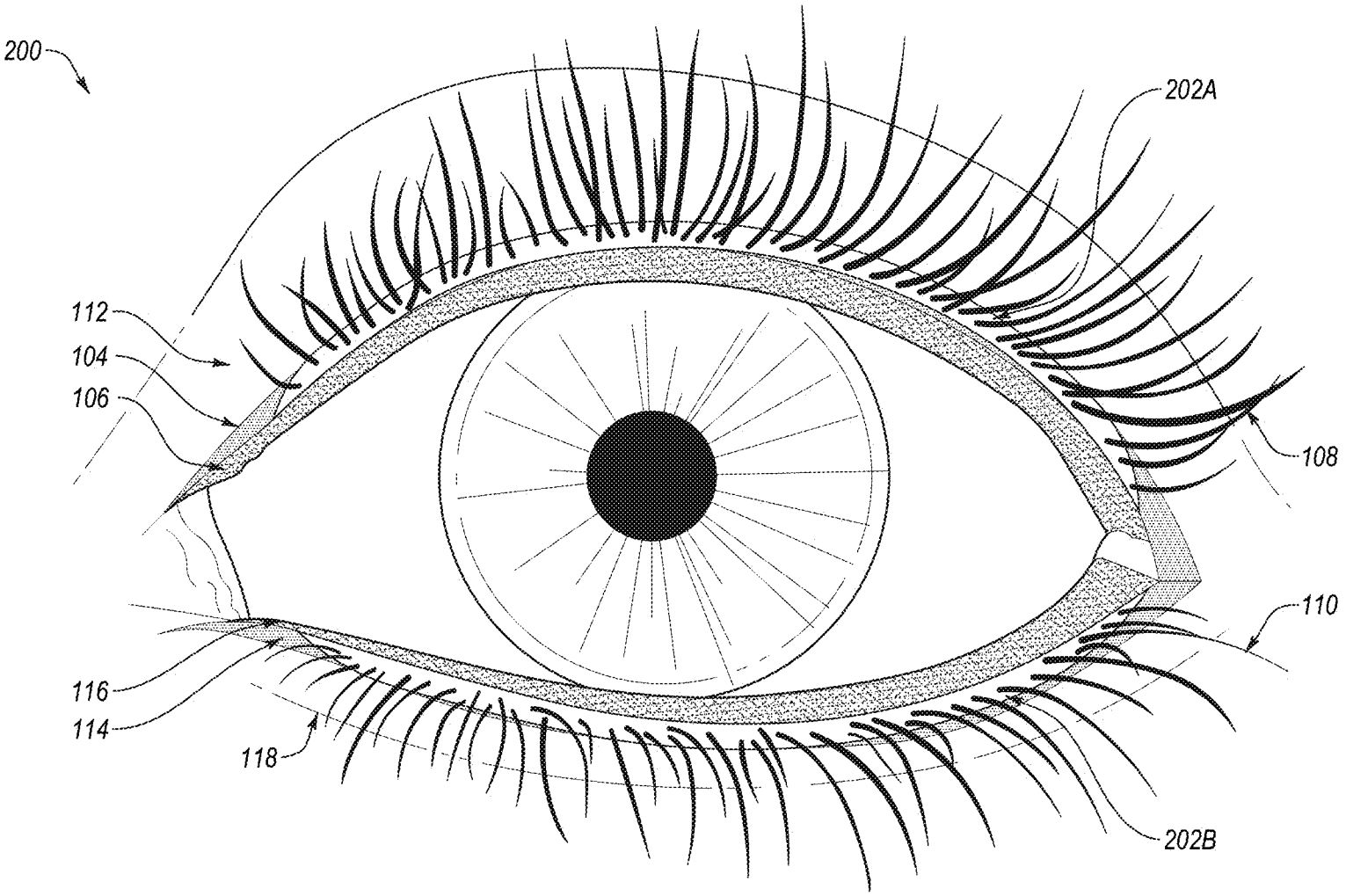
FIG. 2A is an illustration of prosthetic eyelashes applied to a user's eye area, in accordance with some embodiments of the disclosure.

FIG. 2A-2D are illustrations of prosthetic eyelashes, in accordance with some embodiments of the disclosure. FIG. 2A is an illustration of prosthetic eyelashes applied to a user's eye area, in accordance with some embodiments of the disclosure. Prosthetic eyelashes (also referred to as a "prosthetic eyelash unit" herein), such as prosthetic eyelashes 202A (e.g., prosthetic eyelash unit 202A) and prosthetic eyelashes 202B (e.g., prosthetic eyelashes unit 202B), can be part of a prosthetic eyelash system. Prosthetic eyelashes 202A and prosthetic eyelashes 202B can generally be referred to as "prosthetic eyelashes 202" herein. Prosthetic eyelashes 202A illustrate a prosthetic eyelash unit for the upper lash line. Prosthetic eyelashes 202B illustrate a prosthetic eyelash unit for a lower lash line.

As illustrated, in some embodiments, prosthetic eyelashes 202 can be applied, at least in part, directly on the respective lash line of the eye area. In some embodiments, prosthetic eyelashes 202 can be applied to (e.g., adhere to) only the area of the lash line and not extend to the front facing portion of the eyelid (or only slightly extend to the front facing portion of the eyelid), as illustrated in FIG. 2E. For example, one lengthwise side of prosthetic eyelashes 202 can extend close to the waterline and the opposite lengthwise side can extend to the boundary (or thereabouts) of the lash line and front facing portion of the eyelid. In other embodiments, prosthetic eyelashes 202 can be applied to (e.g., adhere to) the area of the lash line and extend to at least part of the front facing portion of the eyelid. For example, one lengthwise side of the prosthetic eyelashes 202 can extent up to the waterline and the opposite lengthwise side can extend past the boundary of the lash line to at least a part of the front facing portion of the eyelid so that a portion of the prosthetic eyelashes 202 adheres to the respective part of the front facing portion of the eyelid. In other embodiments, the prosthetic eyelashes 202 can be applied directly on the eyelid of the eye area and not extend to the adjacent lash line.

It can be noted that prosthetic eyelashes for the upper lash (e.g., prosthetic eyelashes 202A) are further described herein for purposes of brevity, rather than limitation. It should be understood that aspects described with respect to prosthetic eyelashes for the upper lash can apply to prosthetic eyelashes for a lower lash, and vice versa, unless otherwise described. Similarly, it should be understood that aspects described with respect to prosthetic eyelashes for right lashes can applied to prosthetic eyelashes for left lashes, and vice versa, unless otherwise described.

Figure 2B:
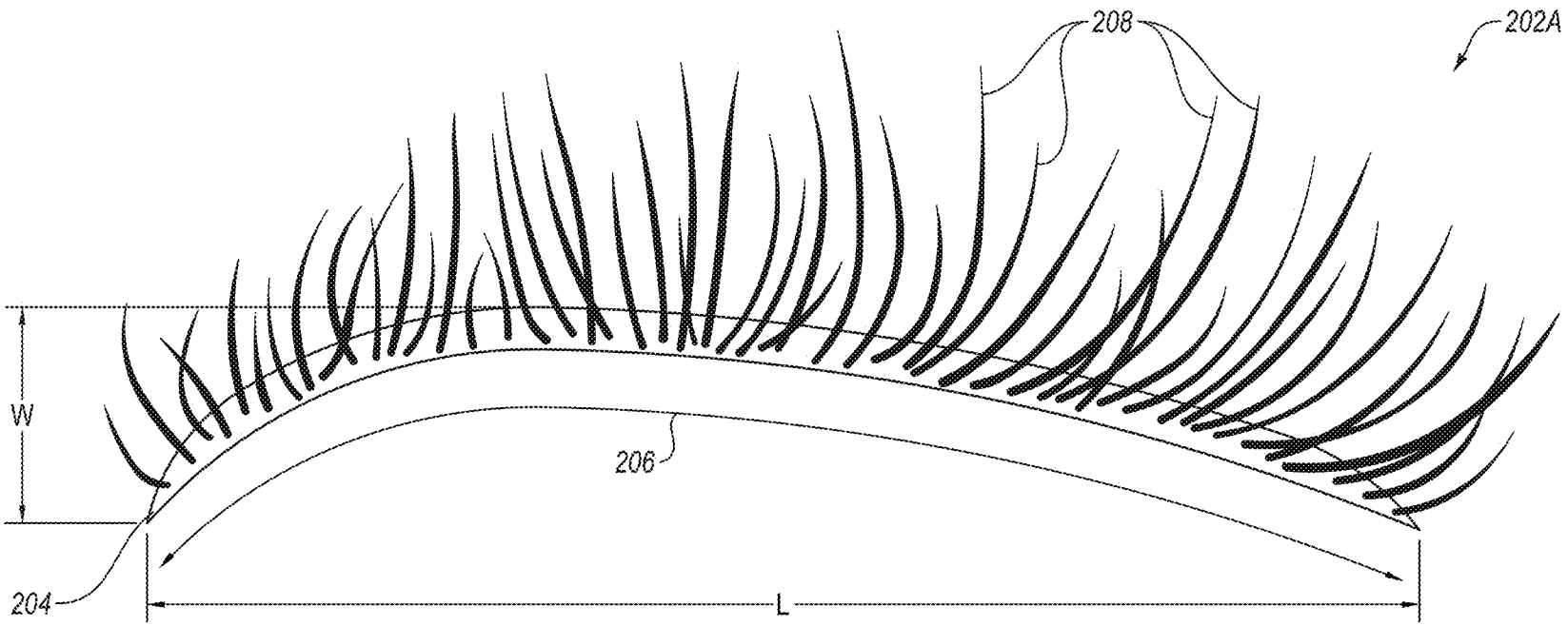
FIG. 2B illustrates a front view of prosthetic eyelashes, in accordance with some embodiments of the disclosure.

FIG. 2B illustrates a front view of prosthetic eyelashes, in accordance with some embodiments of the disclosure. Prosthetic eyelashes 202A include a base 204 and one or more artificial hairs, such as artificial hairs 208 that protrude from the base. In some embodiments, prosthetic eyelashes 202A can be formed in an elongated shape where the length exceeds the width. It can be noted that (L) denotes length and (W) denotes width.

In some embodiments, the base 204 includes a material that is flexible and/or elastic (also referred to as "base material" herein). The flexible and/or elastic characteristics of the base material can allow prosthetic eyelashes 202A to conform to the curve(s) of the surfaces to which the prosthetic eyelash unit is to attach, such as the curve(s) of the lash line, and/or in some embodiments, the curve(s) of the eyelid, and or more generally, the curves of the eye area. The flexible and/or elastic characteristics of the base material can also allow prosthetic eyelashes 202A to conform to the lash lines, and/or in some embodiments, eyelids of different sizes and shapes.

Flexibility can refer the ability of a material or object to bend without breaking. In some embodiments, the flexible characteristics of the base material can allow the base to flex along one or more of the dimensions in three-dimensional space concurrently. Elasticity can refer to the ability of a material or object to be stretched or compressed without breaking. In some embodiments, elasticity can include the ability of a material to return to its original shape after being stretched or compressed. In some embodiments, the elastic characteristics of the base material can allow the base to stretch or compress in one or more of the dimensions in three-dimensional space concurrently. In some embodiments, the flexible and/or elastic material of the base can include one or more of silicone, rubber, latex, a polymer, a co-polymer or a combination thereof.

In some embodiments, the base 204 has one or more curves (also referred to a "curvatures" herein), such as a curve 206 (also referred to as "curvature 206" herein), along one or both lengthwise sides of the base 204. For example, curve 206 extends along the bottom lengthwise side of the base of an upper prosthetic eyelashes, as illustrated. In some embodiments, curve 206 can be, at least in part, concave. In some embodiments, the opposite lengthwise side of the base 204 opposite curve 206 can also have a curve, such as a concave curvature, as illustrated.

In some embodiments, the base 204 of prosthetic eyelashes 202A is formed with the curve 206. For example, the curve 206 can be formed at the time of manufacture and no additional external force is used to form curve 206. In some embodiments, prosthetic eyelashes 202A are formed to have no curve(s) (e.g., straight) that extend along one or more lengthwise sides or formed with one or more different curves that extend along the lengthwise sides. For example, prosthetic eyelashes 202A can be formed at the time of manufacture as a straight line or with less curvature than as illustrated in FIG. 2B. In some embodiments, the flexible and/or elastic base material can allow the prosthetic eyelashes 202, and in particular the base 204, to be shaped to have curve 206 at time of use.

In some embodiments, the flexible and/or elastic characteristics of the base material can allow the user to shape prosthetic eyelashes 202A to have the desired curvature to conform to the user's eye area anatomy, such as the user's lash line and/or eyelid. In some embodiments, the flexible and/or elastic characteristics of the base material can allow the prosthetic eyelashes 202A to conform to the shape of the eyelid only or both the shape of the lash line and the adjacent portion of the eyelid. In some embodiments, prosthetic eyelashes can be designed specific to the lower lash or upper lash, but also designed specific to (e.g. with specific shape, curves or geometry for) one or more of the right lower lash, left lower lash, right upper lash, or left upper lash.

Figure 2C:
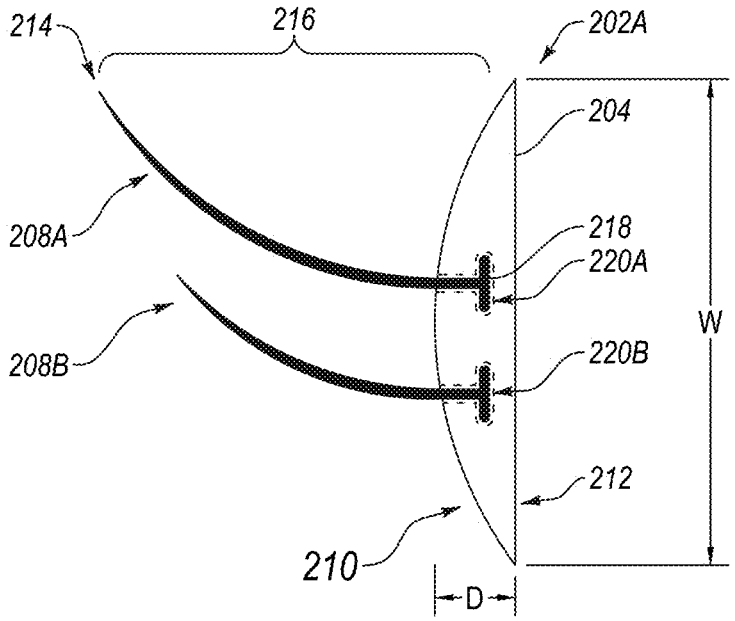
FIG. 2C illustrates a cross-sectional view of prosthetic eyelashes, in accordance with some embodiments of the disclosure.

FIG. 2C illustrates a cross-sectional view of prosthetic eyelashes, in accordance with some embodiments of the disclosure. The cross-sectional view of prosthetic eyelashes 202A shows artificial hair 208A and artificial hair 208B (generally referred to as "artificial hair(s) 208" herein) protruding through a front surface 210 (e.g., front surface of base 204) of prosthetic eyelashes 202A. In some embodiments, an artificial hair, such as artificial hair 208A, can include one or more of a shaft 216 or a root area 218. The distal end of the artificial hair can be referred to as a tip, such as tip 214.

An artificial hair can include or be formed of a natural material or synthetic material. In some embodiments, one or more artificial hairs 208 can include or be formed from one or more synthetic materials, including but not limited to polybutylene terephthalate (PBT), acrylic resin, polyester (e.g., polyethylene terephthalate (PET)), polymer, co-polymer or other synthetic material. In some embodiments, one or more artificial hairs 208 can include or be formed from a natural material such as natural hair (e.g., human hair, mink hair, or other animal hair). In some embodiments, the artificial hairs 208 can have one or more lengths and/or one or more diameters. In some embodiments, the diameter of an artificial hair 208 can be between approximately 0.0075 millimeters (mm) (e.g., 0.0075 mm+/−0.0025 mm) to 0.3 mm (e.g., 0.3 mm+/−0.05 mm). In some embodiments, the ends (e.g., tips) of one or more of the artificial hairs 208 can be tapered. In some embodiments, one or more of artificial hairs 208 can be curled in particular direction. In some embodiments, one or more artificial hairs 208 are not curled (e.g., straight) in any direction. In some embodiments, the artificial hairs 208 can range from 3 mm to 30 mm in length or in some instances even longer (as measured from the root area to the tip of the artificial hair 208).

In some embodiments, the base 204 can include one or more follicle areas, such as follicle area 220A and follicle area 220B (generally referred to as "follicle area(s) 220" herein). In some embodiments, a follicle area can be an area of the base that at least in part surrounds the part of the artificial hair that is within the base 204. In some embodiments, a follicle area can be an area of the base 204 that is located within the base 204 and extends through the front surface 210 of the prosthetic eyelashes 202A. In some embodiments, the follicle areas of prosthetic eyelashes 202A are positioned at different locations along the base 204. In some embodiments, the follicle areas of prosthetic eyelashes 202A are staggered (e.g., offset and not positioned in a straight line) along the length of the base 204. Staggering the follicle areas can make the prosthetic eyelashes 202A appear more realistic.

In some embodiment, one or more artificial hairs can extend from a particular follicle area within the base 204 and through the front surface 210 of the prosthetic eyelashes 202A (e.g. front surface 210 of the base 204). In some embodiments, a single artificial hair extends from each of the follicle areas 220 of prosthetic eyelashes 202A. In other embodiments, 1 to 3 or 1 to 4 artificial hairs extend from each of the follicle areas 220 of prosthetic eyelashes 202A. In some embodiments, 1 to 20 artificial hairs extend from each of the follicle areas of prosthetic eyelashes 202A. In some embodiments, different numbers of artificial hairs extend from different follicle areas 220 of the prosthetic eyelashes 202A.

In some embodiments, a part of the shaft 216 and the root area 218 of an artificial hair 208A can be located within the follicle area 220A of the prosthetic eyelashes 202A. The follicle area 220A can surround the part of the shaft 216 and root area 218 of an artificial hair 208A. For example, the root area 218 is fully enclosed within the base 204 and the root area does not extent through the rear surface 212 of the prosthetic eyelashes 202A. In some embodiments, the root area 218 fully or at least in part extends outside the base 204. For example, the root area 218 can be at least in part located external to the base 204.

In some embodiments, the root area 218 of the artificial hair 208A has a size that is larger than the shaft 216. For example, the diameter of the root area 218 can be larger than the diameter of the shaft 216 of artificial hair 208A. The larger size of the root area 218 can help secure the artificial hair 208A at or to the base 204 (e.g., the hair is not easily pulled through the follicle area 220A). In some embodiments, the root area 218 of the artificial hair 208A is located within the base 204, as illustrated. In some embodiments, the root area 218 is a knot of the artificial hair 208A. In some embodiments, the root area 218 of the artificial hair 208A can be formed by the application of heat as described further below with respect to FIG. 7.

In some embodiments, the number of artificial hairs in prosthetic eyelashes for an upper lash can range from 60 to 200 artificial hairs. In some embodiments, the number of artificial hairs in prosthetic eyelashes for the lower lash can be less than the number of artificial hairs in prosthetic eyelashes for an upper lash. In some embodiments, the number of artificial hairs in prosthetic eyelashes for the lower lash can range from 30 to 100 artificial hairs.

In some embodiments, the curve that extends along (at least part of) the lengthwise side (e.g., bottom lengthwise side) of the base of prosthetic eyelashes for the upper lash can be different from the curve that extends along (at least part of) the lengthwise side (e.g., top lengthwise side) of the base of prosthetic eyelashes for the lower lash. The difference in curves can be implemented to address the different anatomical structures, shapes or features between the upper lash area and the lower lash area (e.g., lash line, eyelid, etc.).

In some embodiments, the colors of the artificial hairs can vary from one prosthetic eyelash unit to another prosthetic eyelash unit. For example, in some prosthetic eyelash units the artificial hairs can be black. In other prosthetic eyelash units the artificial hairs can be brown, blond, or red, for example.

In some embodiments, the prosthetic eyelashes 202A can have a low profile (e.g., depth (D)) so as to appear more realistic when applied to the user. In some embodiments, the depth (D) of the prosthetic eyelashes 202A can be between approximately 0.1 mm (e.g., 0.1 mm+/−0.05 mm) to 0.5 mm (e.g., 0.5 mm+/−0.05 mm) or can be between approximately 0.1 mm (e.g., 0.1 mm+/−0.05 mm) to 0.9 mm (e.g., 0.9 mm+/−0.05 mm) or can be between 0.25 mm (e.g., 0.25 mm+/−0.05 mm) to 1.3 mm (e.g., 1.2 mm+/−0.05 mm). In some embodiments, the depth of the prosthetic eyelashes 202A can be equal to or less than 1 mm or 0.5 mm.

In some embodiments, the prosthetic eyelashes 202A can taper from some point at the body of base 204 (e.g. where an artificial hair protrudes) to one or more lengthwise sides of the prosthetic eyelashes 202A, as illustrated. For example, the midsection area of the base 204 can have the largest depth and can taper towards each lengthwise side. In some embodiments, the front surface of the base can curve between the opposing lengthwise sides, as illustrated. In other embodiments, the prosthetic eyelashes 202A do not taper from some point in the body of base 204 to a lengthwise side of the prosthetic eyelashes 202A (e.g., the front surface 210 of prosthetic eyelashes 202A can be relatively flat).

Figure 2D:
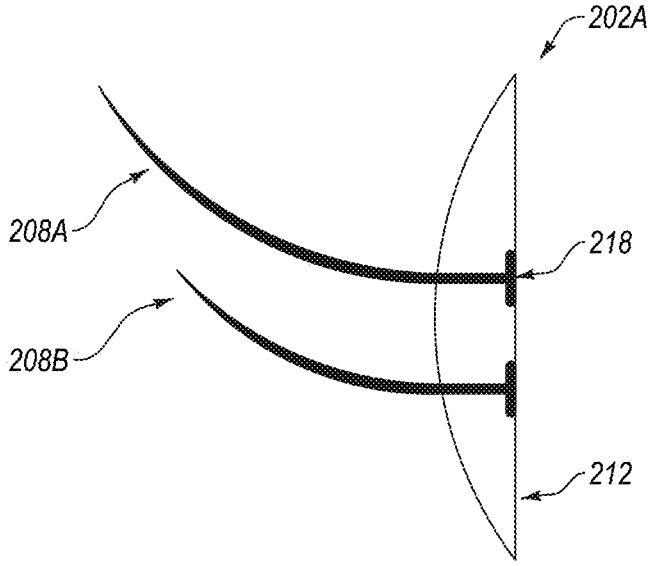
FIG. 2D illustrates a cross-sectional view of prosthetic eyelashes where the artificial hairs extend outside the rear surface of the base, in accordance with some embodiments of the disclosure.
Figure 2E:
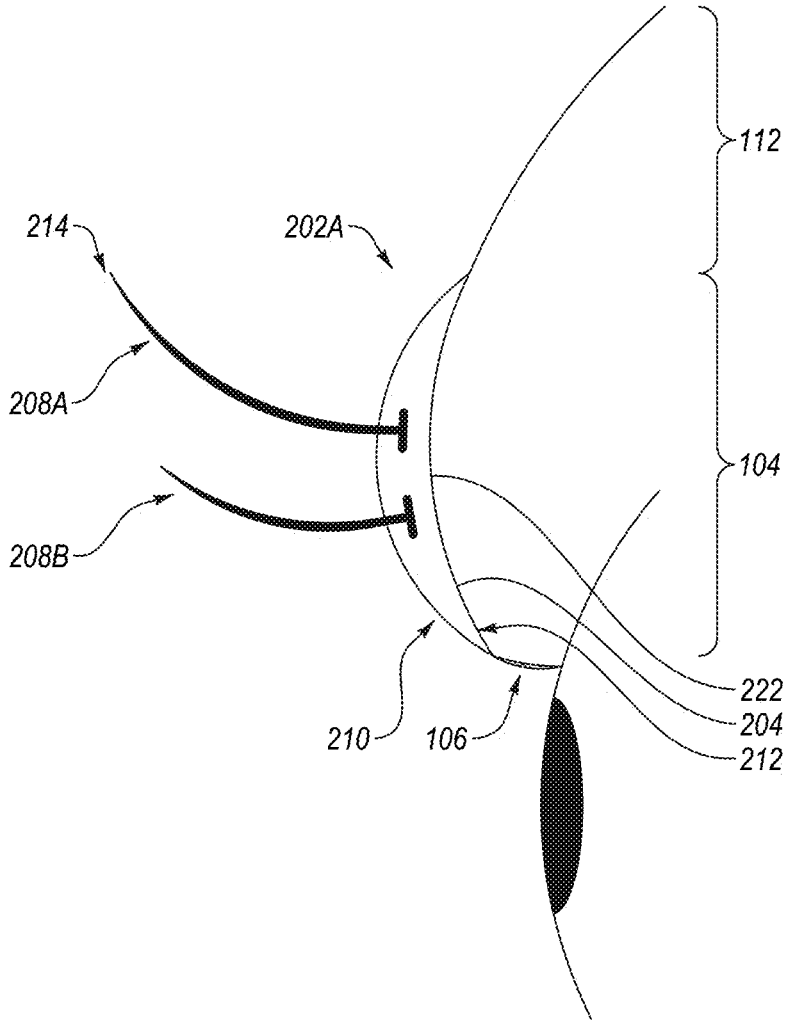
FIG. 2E illustrates a cross-sectional view of prosthetic eyelashes applied to a lash line of a user, in accordance with some embodiments of the disclosure.

FIG. 2D illustrates a cross-sectional view of prosthetic eyelashes where the artificial hairs extend outside the rear surface of the base, in accordance with some embodiments of the disclosure. Prosthetic eyelashes 202A of FIG. 2D illustrate the root area 218 of artificial hair 208A that extends outside of the base 204 of prosthetic eyelashes 202A. In some embodiments, the root area 218 extends to the rear surface 212 of the prosthetic eyelashes 202A (e.g., rear surface 212 of the base 204). In some embodiments, the rear surface of the root area 218 is substantially flush with the rear surface 212 of the prosthetic eyelashes 202A. In some embodiments, the rear surface of the root area 218 can extend beyond the rear surface 212 of the prosthetic eyelashes 202A (e.g. external to the base). In some embodiments, an additional layer of material (not shown), such as an additional layer of base material or other material, can be applied to the rear surface 212 of the base 204. In some embodiments, the additional layer of material can cover the root area 218 of the artificial hairs that are exposed through the rear surface 212 of the base 204. In some embodiments, an adhesive layer can be applied over the additional material so that the adhesive forms the rear surface of prosthetic eyelashes 202A.

FIG. 2E illustrates a cross-sectional view of prosthetic eyelashes applied to a lash line of a user, in accordance with some embodiments of the disclosure. In some embodiments, the rear surface 212 of the prosthetic eyelashes 202A (e.g., rear surface 212 of base 204) can be formed with no curve (e.g., flat) between the lengthwise sides of the prosthetic eyelashes 202A (e.g., lengthwise sides of the base 204), as illustrated in FIG. 2C. In some embodiments, the flexible and/or elastic material of the base 204 is designed to bend to form a curve 222 (e.g., also referred to a "curvature" herein, such as concave curvature) at the rear surface of the prosthetic eyelashes 202A between the lengthwise sides of the prosthetic eyelashes 202A. In some embodiments, the flexible and/or elastic material of the base 204 can conform to the shape of the lash line 104 (or other anatomical shapes) of the user's eye area, as illustrated. In some embodiments, the flexible and/or elastic characteristics of the material of the base 204 can enable the prosthetic eyelashes 202A to bend to form curve 222 such that prosthetic eyelashes 202A can be applied to and securely attached to at least part of the lash line 104 of the user.

In some embodiments, prosthetic eyelashes 202A are formed to have a curve with different or less curvature than curve 222 of FIG. 2E. For example, prosthetic eyelashes 202A can be formed at the time of manufacture having a rear surface with less curvature than curve 222.

In some embodiments, prosthetic eyelashes 202A are formed with curve 222. For example, the curve 222 can be formed at the time of manufacture and no additional external force is used to form curve 222.

In some embodiments, the prosthetic eyelashes 202A attach to at least part of the lash line 104 of the user. In some embodiments as illustrated in FIG. 2E, one lengthwise side (e.g., bottom lengthwise side) can extend close to the waterline 106 and the other lengthwise side can extend close to the boundary between the lash line 104 and the eyelid 112 (e.g., front surface of the eyelid) of the user. In some embodiments, one lengthwise side of prosthetic eyelashes 202A can extend close to the waterline 106 and the other lengthwise side can extend to a portion of the eyelid 112 of the user.

In some embodiments, the rear surface 212 of the prosthetic eyelashes 202A (e.g., rear surface 212 of base 204) can be coated with a layer of adhesive (also referred to as an "adhesive layer" herein). In some embodiments, the layer of adhesive can be applied at the time of manufacture. In some embodiments, the adhesive can be applied by a user prior to application of the prosthetic eyelashes 202A to the user's lash line, for example. In some embodiments, the adhesive can be applied to the rear surface 212 of the prosthetic eyelashes 202A by the user. In some embodiments, an adhesive can be applied to a surface of the eye area (e.g., the lash line and and/or eyelid) of the user prior to the application of the prosthetic eyelashes 202A. The pre-applied adhesive layer or adhesive compound (e.g., in a dispenser or container for use by the user) can be part of the prosthetic eyelashes system. The adhesive may be one or more of a glue, an eyeliner, a bonding agent, an epoxy, a paste, or any other natural or synthetic substance having adhesive characteristics.

In some embodiments, the adhesive may include a moisturizing component. A moisturizing component can refer to a substance used for protecting, moisturizing, or lubricating the skin. The moisturizing component of the adhesive can help protect the skin, and in particular the sensitive skin at the lash line or eyelid. The moisturizing component can include a natural (e.g. aloe) element, synthetic element, or a combination thereof. The moisturizing component can include one or more of a humectant, occlusive, or emollient.

In some embodiments, the adhesive may include one or more of an anti-irritant component that has anti-irritant properties, an anti-microbial component that has anti-microbial properties, or an anti-inflammatory component that has anti-inflammatory properties. Such material(s) can include charcoal powder or other material.

In some embodiments, the adhesive may be a waterproof formulation that allows prosthetic eyelashes 202A to remain affixed to the user's skin for periods of time (e.g., hours, days, weeks, or months). The adhesive may also allow the attached prosthetic eyelashes to be submerged in water and remain affixed to the user's skin. In some embodiments, the adhesive may be clear or colored (e.g., milky white or black to emulate eyeliner). In some embodiments, the adhesive may be applied using a brush, a comb, or any other type of application tool. In some embodiments, the adhesive may be applied at the lash line. In other embodiments, the adhesive may be applied at any location along the eye area, such as the lash line, at least a portion of the eyelid, or a combination thereof.

In some embodiments, at least part of the front surface 210 of the base 204 can have a colorant, such as a skin-tone colorant. Different prosthetic eyelashes can have front surfaces having different skin-tone colorants to help match the skin tone of the user and so that the prosthetic eyelashes blend with the natural skin color of the user. In some embodiments, at least part of the front surface of 210 of the base 204 is opaque. In some embodiments, the base 204 is transparent or at least partially transparent.

In some embodiments, the front surface 210 of the prosthetic eyelashes 202A (e.g., base 204) is configured to receive an application of a cosmetic, such as eye liner, eye shadow, or mascara. The front surface 210 of the base 204 can receive the application of the cosmetic and the cosmetic can bond or adhere to the front surface of the base in a similar manner that the cosmetic bonds or adheres to a user's natural skin. The cosmetic can adhere to the front surface 210 of the prosthetic eyelashes 202A (e.g., base 204) for an extended period of time (e.g., hours or days) and can be removed from the front surface 210 of the base 204 with the application of water or special-purpose cleaners.

In some embodiments, the prosthetic eyelashes as described herein can be used once. In some embodiments, the prosthetic eyelashes as described herein can be used or re-used multiple times.

In some embodiments, the artificial hairs are attached to the base 204 by an attachment process that pulls one or more of the artificial hairs through the base. In some embodiments, the artificial hairs can be pulled from the rear surface 212 of the base 204 through the front surface 210 of the base 204. In some embodiments, the artificial hairs can be pulled from the front surface 210 of the base 204 through the rear surface 212. For example, the artificial hairs can be threaded through the base 204 using a needle or other tool. In some embodiments, the each of the artificial hairs can be secured to the base using one or more knots at the proximal ends (e.g., root near the rear surface 212 of the base 204). In some embodiments, each of the artificial hairs can be secured to the base 204 using an adhesive. For example, the proximal ends of the artificial hairs (e.g., root) can be secured near the rear surface 212 of the base 204 using an adhesive such that the adhesive prevents the artificial hairs from being easily pulled through the base 204. In some embodiments, the artificial hairs can be secured to the base 204 using an application of heat as described herein. In some embodiments, the artificial hairs can be secured to the base 204 using a combination of techniques as described herein (e.g., knot, adhesive, heat, or a combination thereof).

In some embodiments, the front surface 210 of the base 204 includes an elongated shape defined by a colorant, such as a black colorant. The elongated shape is configured to resemble eyeliner. For example, prosthetic eyelashes 202A for the upper lash line can include a stripe of black colorant above the artificial hairs such that the stripe resembles eyeliner.

Figure 2F:
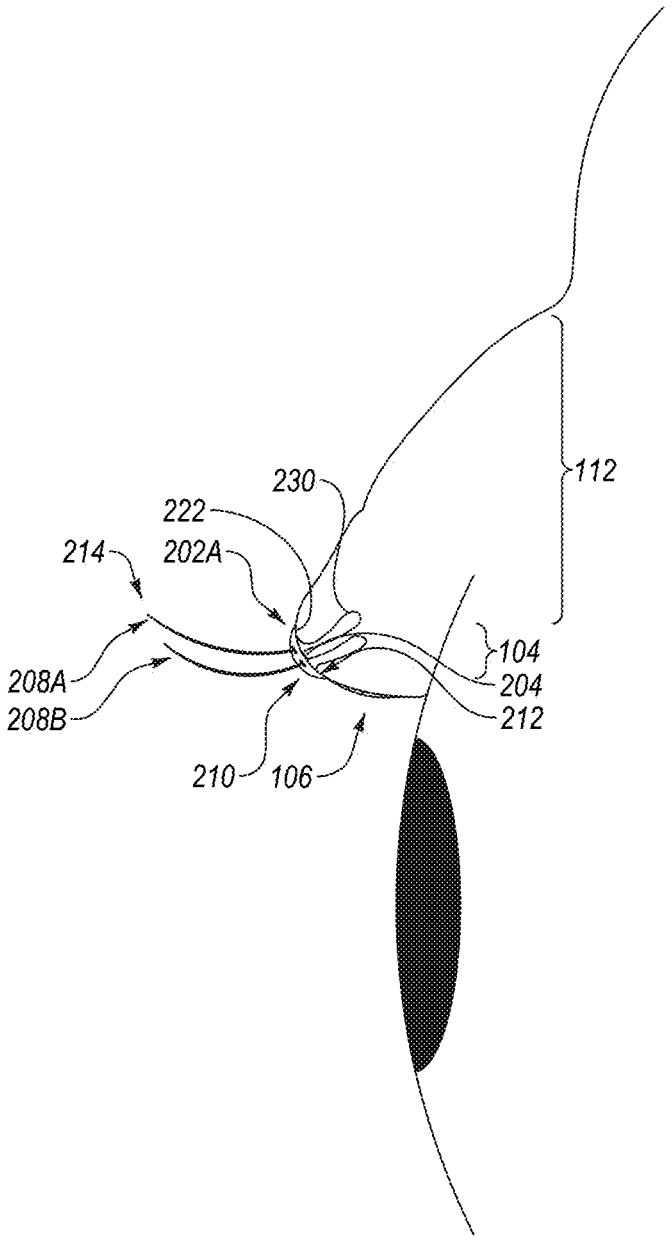
FIG. 2F illustrates a cross-sectional view of prosthetic eyelashes applied to a lash line of a user, in accordance with some embodiments of the disclosure.

FIG. 2F illustrates a cross-sectional view of prosthetic eyelashes applied to a lash line of a user, in accordance with some embodiments of the disclosure. FIG. 2F is similar to FIG. 2E and the elements described with respect to FIG. 2E also apply to FIG. 2F, and vice versa, unless otherwise described. FIG. 2F is provided to present, with greater precision, anatomical features of the eye area and the application of prosthetic eyelashes 202A thereupon, in accordance with some embodiments. As illustrated, the front surface of the eyelid 112 faces outwards. The eyelid begins to curve towards the eye near the bottom of the eyelid. The lash line 104 is located at the curve of the eyelid and faces a different direction than the front surface of the eyelid 112 (e.g., the angle between a vector orthogonal to the front surface of the eyelid and a vector orthogonal to the center of the lash line approximately 35 degrees or greater). The natural eyelash follicles 230 (illustrated without eyelashes) are illustrated at the lash line 104. The bottom of the eyelid that includes the lash line 104 and the waterline 106 forms a shelf that is at an angle to the front surface of the eyelid 112. The prosthetic eyelashes 202A can be attached on the lash line and on the natural eyelash follicles 230, as illustrated and in accordance with some embodiments.

Figure 3A:
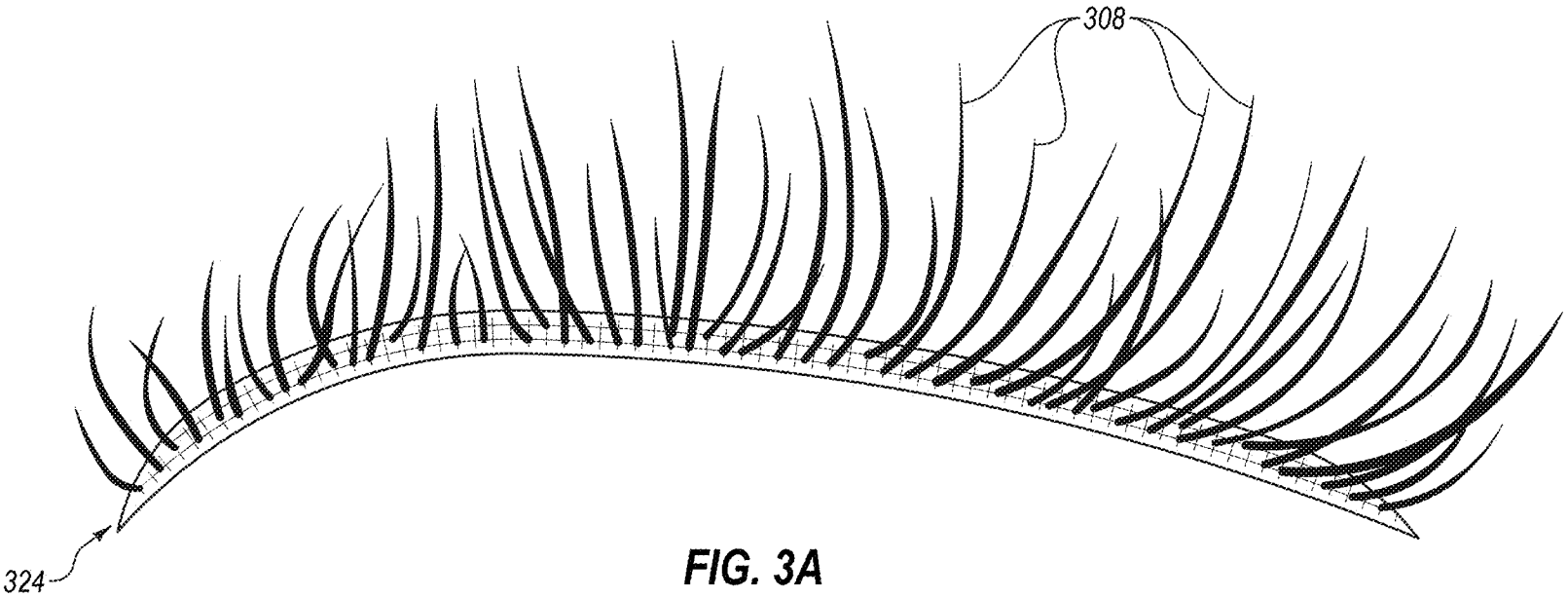
FIG. 3A illustrates a hair attachment layer of prosthetic eyelashes, in accordance with some embodiments.

FIG. 3A illustrates a hair attachment layer of prosthetic eyelashes, in accordance with some embodiments. Elements described with respect to FIG. 1 and FIG. 2A-2E are used to help describe aspects of FIG. 3A-3C. The description of corresponding elements described with respect to FIG. 1 and FIG. 2A-2E apply to the corresponding elements of FIG. 3A-3C, and vice versa, unless otherwise described. For example, the description of base 204 of FIG. 2B-2E can apply to base 304 of FIG. 3B-3C, unless otherwise described.

In some embodiments, a base of prosthetic eyelashes can include another material, such as a hair attachment layer 324. A hair attachment layer 324 can include a material to which one or more artificial hairs 308 of prosthetic eyelashes are attached or secured. In some embodiments, the hair attachment layer 324 is a material that is different than the flexible and/or elastic material of the base 204, as discussed above. In some embodiments, hair attachment layer 324 is also a flexible and/or elastic material. In some embodiments, hair attachment layer 324 can be a woven or fabric material and include a mesh-like or net-like pattern (e.g., microfiber netting). In some embodiments, artificial hairs 308 can be woven into hair attachment layer 324. For example, one or more knots can be used to secure an artificial hair 308 to the hair attachment layer 324. In other embodiments, the artificial hairs 308 can be secured to the hair attachment layer 324 by any feature or technique.

In some embodiments, the one or more artificial hairs 308 attached to hair attachment layer 324 can be implemented as prosthetic eyelashes (hereinafter referred to "hair attachment layer prosthetic eyelashes"). For example, hair attachment layer prosthetic eyelashes with the one or more artificial hairs 308 attached to hair attachment layer 324 can be implemented without an additional base. In some embodiments, an adhesive layer can be applied to the rear surface of the hair attachment layer 324 and the hair attachment layer prosthetic eyelashes can be applied directly to one or more of the user's lash line or eyelid. In some embodiments, the user can apply an adhesive to one or more of the user's lash line or eyelid and attach hair attachment layer prosthetic eyelashes to the corresponding surface of the user's eye area. In some embodiments, some or all of the rear surface of the hair attachment layer 324 can have one or more layers of the base material (e.g., the hair attachment layer 324 is sandwiched between base materials). In some embodiments, an adhesive layer can be disposed on the rear surface of the last most layer of base material. In some embodiments, the hair attachment layer 324 can be transparent or partially transparent. In other embodiments, the hair attachment layer 324 can be a skin-tone color or any other color. In some embodiments, the hair attachment layer prosthetic eyelashes can include one or more characteristics as described with respect to other prosthetic eyelashes (as described herein), unless otherwise described. In some embodiments, the hair attachment layer 324 can be considered as part of a base and include the characteristics of the base (as described herein), unless otherwise described. For example, in some embodiments, the hair attachment layer prosthetic eyelashes can have a curve that extends along the lengthwise side. In some embodiments, the rear surface of the hair attachment layer prosthetic eyelashes can bend between the lengthwise sides to form a curve that conforms to a shape of the lash line of the user.

Figure 3B:
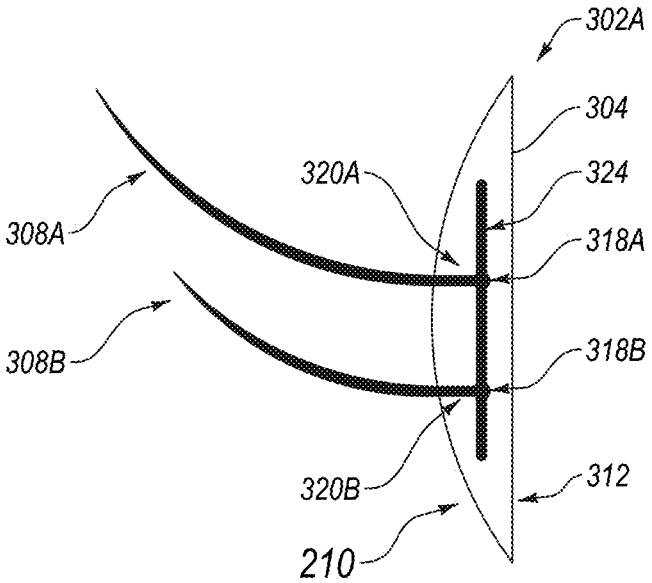
FIG. 3B illustrates a cross-sectional view of prosthetic eyelashes with a hair attachment layer, in accordance with some embodiments of the disclosure.

FIG. 3B illustrates a cross-sectional view of prosthetic eyelashes with a hair attachment layer, in accordance with some embodiments of the disclosure. It can also be noted that in some embodiments prosthetic eyelashes that use hair attachment layer 324 can externally look like prosthetic eyelashes 202A as described herein, such as prosthetic eyelashes 202A and prosthetic eyelashes 202B as illustrated in FIG. 2A-2B.

A cross-sectional view of prosthetic eyelashes 302 are illustrated showing hair attachment layer 324 embedded within the base 304. Artificial hair 308A and artificial hair 308B (generally referred to as "artificial hair(s) 308" herein) are attached to hair attachment layer 324 and extend from the follicle areas (e.g., follicle area 320A and follicle area 320B, respectively) through the front surface of the base 304. Root area 318A of artificial hair 308A and root area 318B of artificial hair 308B (generally referred to as "root area(s) 318" herein) are the areas of the artificial hairs that are attached to hair attachment layer 324. In some embodiments, root area 318 has a diameter that is wider than the shaft of the corresponding artificial hair. Hair attachment layer 324 is illustrated as embedded (e.g., fully embedded) within the material of the base 304. In some embodiments, an adhesive layer can be applied on the rear surface 312 of base 304.

Figure 3C:
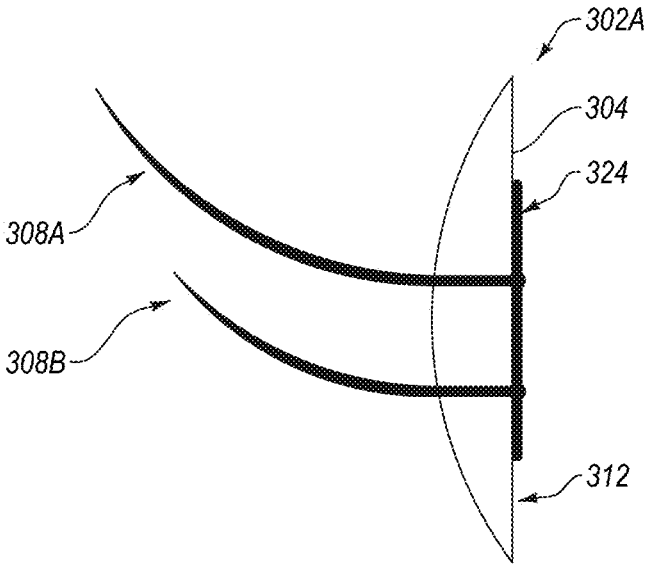
FIG. 3C illustrates a cross-sectional view of prosthetic eyelashes where a hair attachment layer extends at least partly outside the rear surface of the base, in accordance with some embodiments of the disclosure.

FIG. 3C illustrates a cross-sectional view of prosthetic eyelashes where hair attachment layer extends at least partly outside the rear surface of the base, in accordance with some embodiments of the disclosure. Prosthetic eyelashes 302A as shown in FIG. 3C illustrate an embodiment where the hair attachment layer 324 extends at least partly outside the rear surface 312 of the base 304 (e.g., partially embedded in the material of the base 304 or completely external to the base 304). In some embodiments, an adhesive layer can be applied on the rear surface 312 of base 304 where the adhesive surface covers all or part of the exposed hair attachment layer 324 (e.g., and in some embodiments the root area(s) 318 of the artificial hairs 308). In some embodiments, an additional layer of material (not shown), such as an additional layer of base material or other material, can be applied to the rear surface 312 of the base 304. In some embodiments, the additional layer of material can cover the hair attachment layer 324 and/or the root areas 318 of the artificial hairs that are exposed at the rear surface 312 of the base 304. In some embodiments, an adhesive layer can be applied over the additional material so that the adhesive forms the rear surface of prosthetic eyelashes 302A.

Figure 4:
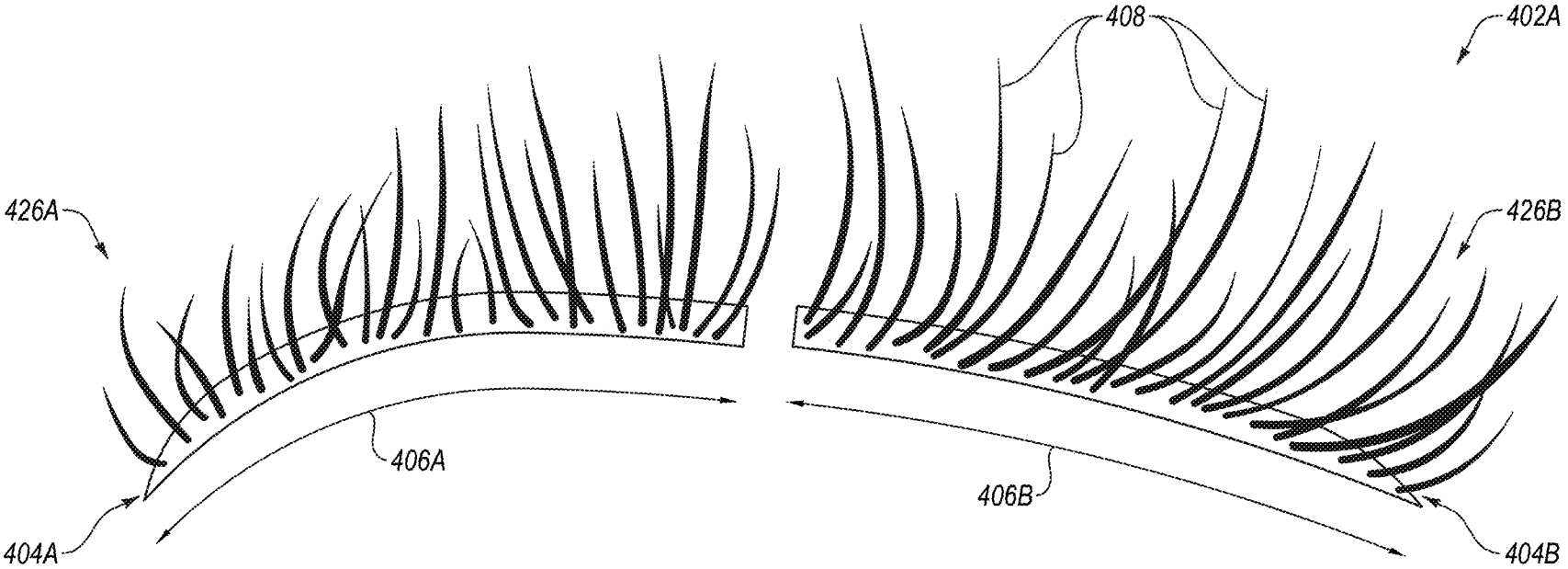
FIG. 4 illustrates prosthetic eyelashes having multiple segments, in accordance with some embodiments of the disclosure.

FIG. 4 illustrates prosthetic eyelashes having multiple segments, in accordance with some embodiments of the disclosure. Prosthetic eyelashes 402A (e.g., also referred to "prosthetic eyelash unit 402A" herein) illustrates a prosthetic eyelash unit having multiple segments. In some embodiments, prosthetic eyelashes, such as prosthetic eyelashes 202A of FIG. 2B, can have a single segment. In other embodiments, prosthetic eyelashes, such as prosthetic eyelashes 402A, can have two or more segments that make up particular prosthetic eyelashes or prosthetic eyelash unit. In some embodiments, the number of segments of a prosthetic eyelash unit range from 2 to 5 segments. In other embodiments, any number of segments can make up a particular prosthetic eyelash unit.

Prosthetic eyelash unit 402A is shown with two segments, prosthetic eyelash segment 426A and prosthetic eyelash segment 426B (generally referred to as "prosthetic eyelash segment(s) 426" herein), for purposes of illustration rather than limitation. Each prosthetic eyelash segment 426 has a base, such as base 404A or base 404B (generally referred to as "base(s) 404" herein). A base 404 can be similar to other bases described herein, unless otherwise described. In some embodiments, one or more of the prosthetic eyelash segments 426 has a curve that extends along at least one lengthwise side of the base 404, as illustrated by curve 406A and curve 406B. In some embodiments, the curves of different prosthetic eyelash segments of a prosthetic eyelash unit can have different curves along the lengthwise side of the base 404 to conform to the different curves of the eye areas where the prosthetic eyelash segments are to be attached. For example, curve 406A can be curved for the curvature of the inner portion of the lash line (e.g., nearest the nose) and curve 406B can be curved for the curvature of the outer portion of the lash line (e.g., closest to the ear) for a left eye area.

In some embodiments, each of the prosthetic eyelash segments 426 can include one or more artificial hairs, such as artificial hairs 408. The prosthetic eyelash segments 426 are designed to align adjacent (e.g., directly adjacent) to one another at the lash line, eyelid, or combination thereof of the user. In some embodiments, prosthetic eyelashes having multiple segments are designed to allow the prosthetic eyelashes to be better secured to a user's eye area (e.g., lash line, eyelid, or combination thereof) and/or to create a more natural feel when attached to a user. For example, the lash line of a user can move in a non-linear manner. For instance, the inner portion of the lash line (closest to the nose) may move more than the outer portion of the lash line when the user squints or blinks. In some embodiments, having multiple segments for a prosthetic eyelash unit allows the different segments to move different amounts without pulling on one another or stretching an adjacent segment, which creates for more secure prosthetic eyelashes with better natural feel. It can be noted that any of the prosthetic eyelashes described herein can be implemented with one or more prosthetic eyelash segments, in some embodiments.

Figure 5A:
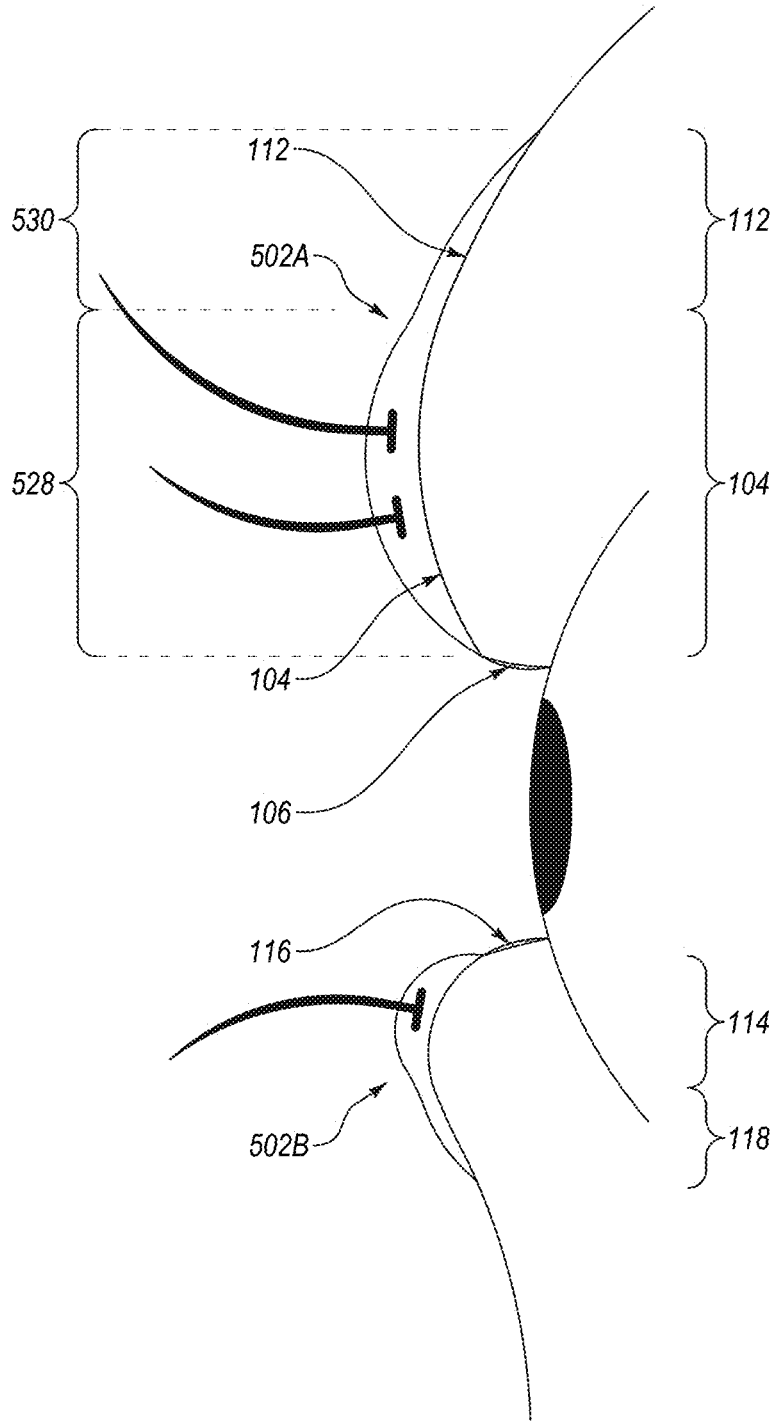
FIG. 5A illustrates a prosthetic eyelashes having a lash line portion and an eyelid portion, in accordance with some embodiments of the disclosure.

FIG. 5A illustrates prosthetic eyelashes having a lash line portion and an eyelid portion, in accordance with some embodiments of the disclosure. Elements described with respect to FIG. 1-4 are used to help describe aspects of FIG. 5A-5B. The description of corresponding elements described with respect to FIG. 1-4 apply to the corresponding elements of FIG. 5A-5B, and vice versa, unless otherwise described.

Prosthetic eyelashes 502A and 502B (generally referred to as "prosthetic eyelashes 502" herein) are shown in a side view as applied to a user. In some embodiments, prosthetic eyelashes, such as prosthetic eyelashes 502A and 502B, can have a lash line portion and an eyelid portion. For example, prosthetic eyelashes 502 is illustrated with lash line portion 528 and eyelid portion 530. The lash line portion 528 of the base 504 of prosthetic eyelashes 502A (and prosthetic eyelashes 502B) is designed such that the rear surface of the base can bend between the lengthwise sides of the base 504 to form a curve that conforms to a shape of the lash line of the user.

In some embodiments, the lash line portion 528 of prosthetic eyelashes 502A include one or more artificial hairs. In some embodiments, the lash line portion 528 is designed to attach to a lash line of the user, as described above.

In some embodiments, the eyelid portion 530 of the prosthetic eyelashes 502A is designed to attached to an eyelid of the user. In some embodiments, the eyelid portion 530 of the prosthetic eyelashes 502A do not include any artificial hairs. In some embodiments, the eyelid portion 530 of the prosthetic eyelashes 502A is part of the base of the prosthetic eyelashes 502A. In other embodiments, the eyelid portion 530 of prosthetic eyelashes 502A is separate from the lash line portion 525 of prosthetic eyelashes 502A (e.g., independent and detached from one another). In some embodiments, the flexible and/or elastic characteristics of the base material allow the eyelid portion 530 of the prosthetic eyelashes 502A to attach to the eyelid of the user. In some embodiments, the lengthwise side of the eyelid portion 530 can have a shape that is different than the opposite lengthwise side of the lash line portion 528. In some embodiments, the lengthwise side of the eyelid portion 530 can be relatively straight or have less or a different curvature than the curve at the lengthwise side of the lash line portion 528.

It can be noted that prosthetic eyelashes 202A illustrated in FIG. 2E show prosthetic eyelashes with only a lash line portion and without an eyelid portion. In some embodiments, prosthetic eyelashes can include only an eyelid portion and no lash line portion.

Figure 5B:
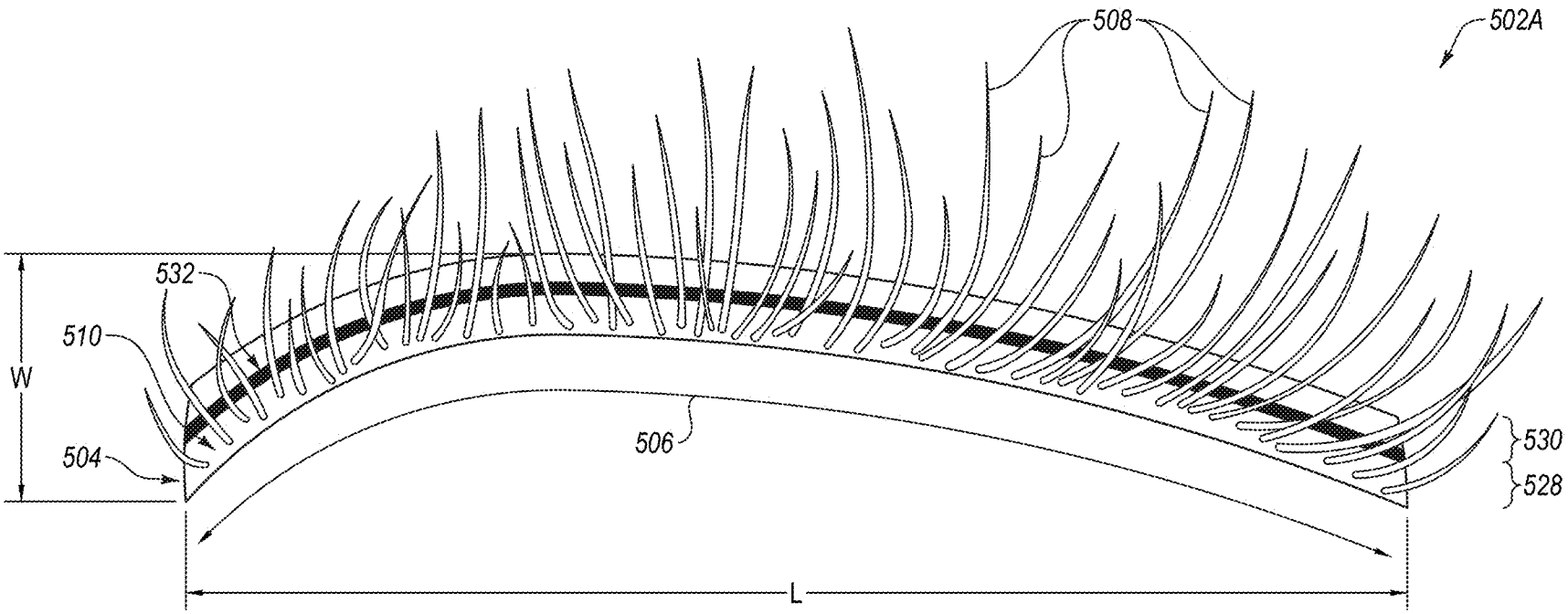
FIG. 5B illustrates prosthetic eyelashes having a lash line portion and an eyelid portion, in accordance with some embodiments of the disclosure.

FIG. 5B illustrates prosthetic eyelashes having a lash line portion and an eyelid portion, in accordance with some embodiments of the disclosure. Prosthetic eyelashes 502A are shown in a front view. Prosthetic eyelashes 502A shows the base 504 of prosthetic eyelashes 502A having the lash line portion 528 and the eyelid portion 530. The lash line portion 528 of prosthetic eyelashes 502A includes one or more artificial hairs 508. In some embodiments, the eyelid portion 530 of prosthetic eyelashes 502A does not include artificial hairs. In other embodiments, the eyelid portion 530 of prosthetic eyelashes 502A can include one or more artificial hairs.

In some embodiments, the eyelid portion 530 of prosthetic eyelashes 502A can include a colorant on at least the front surface 510 of the eyelid portion 530 (e.g., base 504) of prosthetic eyelashes 502A. The colorant on at least the front surface 510 of the eyelid portion 530 of prosthetic eyelashes 502A can be different than a colorant (or color) on at least a portion of the front surface 510 of the lash line portion 528 of the prosthetic eyelashes 502A. In some embodiments, the colorant on the front surface 510 of the eyelid portion 530 of prosthetic eyelashes 502A can be a black or charcoal color or another color that emulates or resembles eyeliner. In some embodiments, the front surface 510 of the eyelid portion 530 includes an elongated shape 532 having or defined by a colorant.

In some embodiments, the base 504 includes a curve 506 in a direction of lengthwise side of the base 504.

Figure 6A:
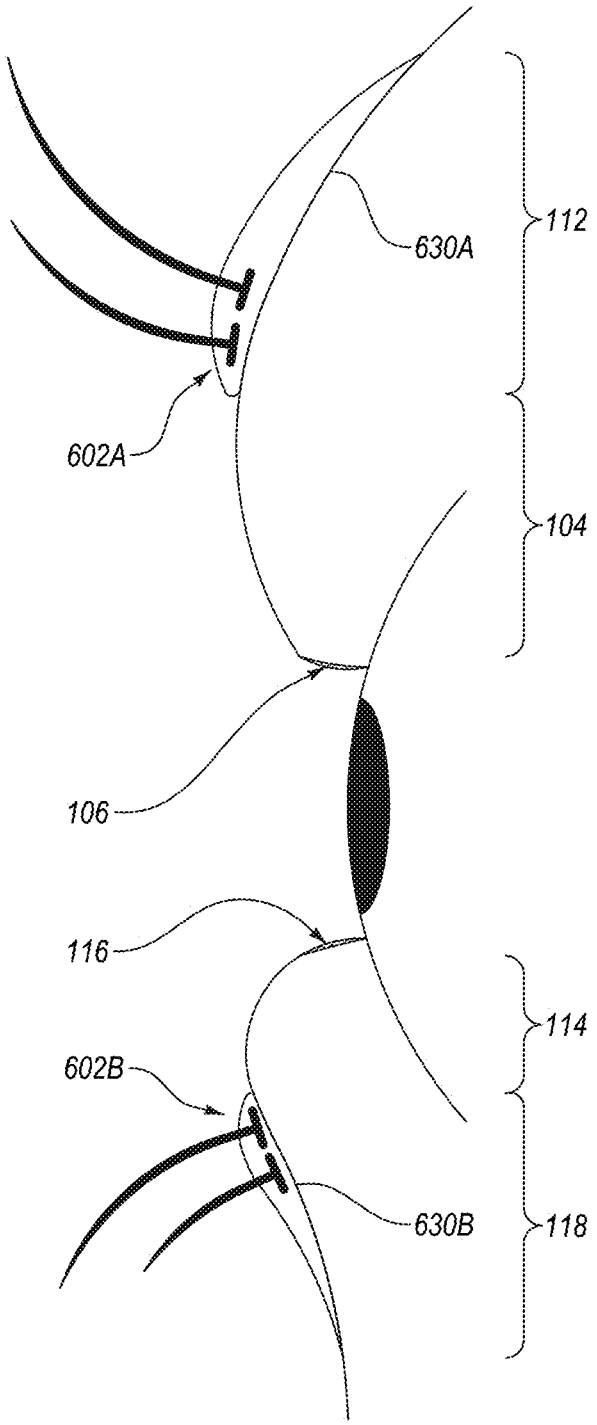
FIG. 6A illustrates prosthetic eyelashes having an eyelid portion, in accordance with some embodiments of the disclosure.

FIG. 6A illustrates a prosthetic eyelashes having an eyelid portion, in accordance with some embodiments of the disclosure. Elements described with respect to FIG. 1-5B are used to help describe aspects of FIG. 6A-6B. The description of corresponding elements described with respect to FIG. 1-5B apply to the corresponding elements of FIG. 6A-6B, and vice versa, unless otherwise described.

Prosthetic eyelashes 602A and 602B (generally referred to as "prosthetic eyelashes 602" herein) are shown in a side view as applied to a user. In some embodiments, prosthetic eyelashes, such as prosthetic eyelashes 602A and 602B, can have an eyelid portion (with or without a lash line portion). For example, prosthetic eyelashes 602A is illustrated with eyelid portion 630A and prosthetic eyelashes 602B is illustrated with eyelid portion 630B (e.g. no lash line portion). Eyelid portion 630A and eyelid portion 630B are generally referred to as "eyelid portions(s) 630" herein.

In some embodiments, the eyelid portions 630 of prosthetic eyelashes 602 can include one or more artificial hairs. In some embodiments, the eyelid portions 630 are designed to attach to eyelids of the user. The flexible and/or elastic base material can conform to the shape of the eyelids of the user. In some embodiments, a curve 606 that extends along lengthwise side of the base can conform to the curve of the eyelid adjacent to the lash line.

In some embodiments, the eyelid portion 630 of the prosthetic eyelashes 602 is designed to attach to an eyelid of the user. In some embodiments, the eyelid portion 630 of the prosthetic eyelashes 602 includes one or more artificial hairs. In some embodiments, the flexible and/or elastic characteristics of the base material allow the eyelid portion 630 of the prosthetic eyelashes 602A to attach to the eyelid of the user. In some embodiments, the upper lengthwise side of the eyelid portion 630 can have a shape that is different the than the lower lengthwise side of the eyelid portion 630. In some embodiments, the upper lengthwise side of the eyelid portion 630 (e.g., for upper lash prosthetic eyelashes) can be relatively straight or have less or a different curvature than the curvature at the lower lengthwise side of the eyelid portion 630 (which may be opposite for lower lash prosthetic eyelashes).

Figure 6B:
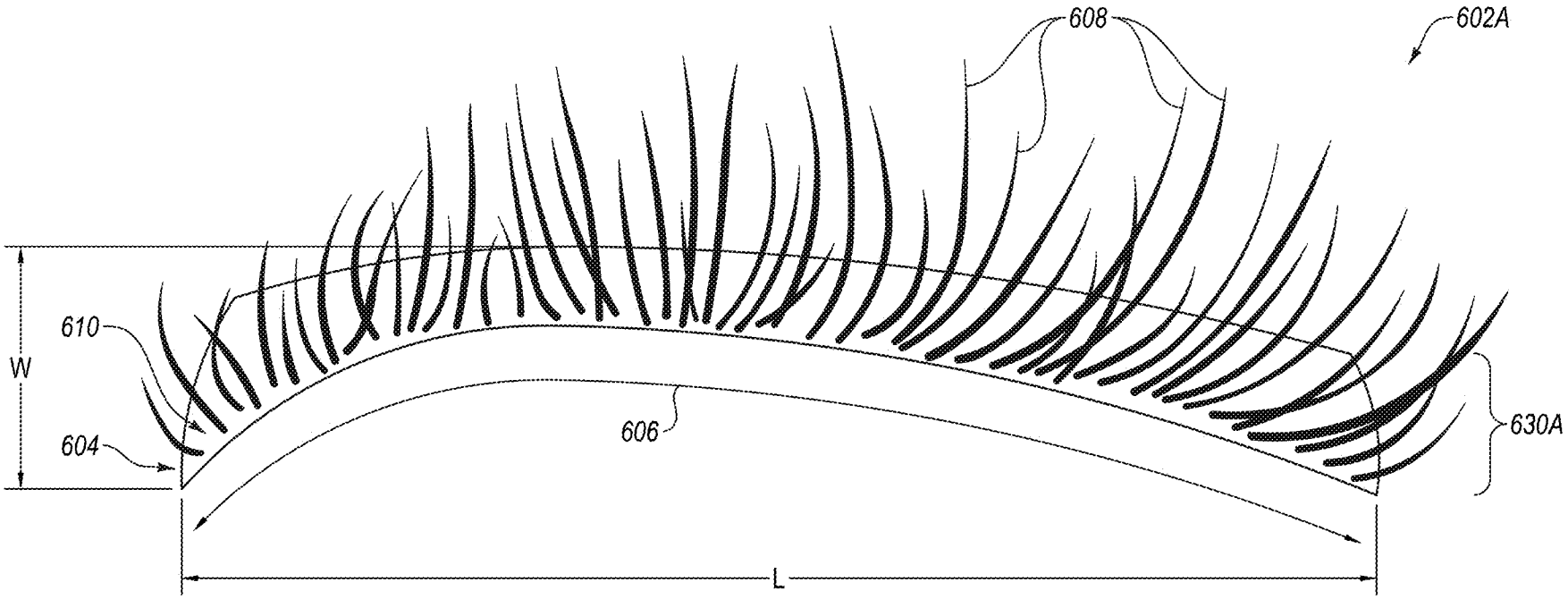
FIG. 6B illustrates prosthetic eyelashes having an eyelid portion, in accordance with some embodiments of the disclosure.

FIG. 6B illustrates prosthetic eyelashes having an eyelid portion, in accordance with some embodiments of the disclosure. Prosthetic eyelashes 602A are shown in a front view. Prosthetic eyelashes 602A show the base 604 having the eyelid portion 630A. The eyelid portion 630A of prosthetic eyelashes 602A includes artificial hairs. In some embodiments, one or more of the artificial hairs of prosthetic eyelashes 602A protrude through the front surface of prosthetic eyelashes 602A. In some embodiments, one or more artificial hairs of prosthetic eyelashes 602A protrude through a lengthwise side (e.g., lower lengthwise side of prosthetic eyelashes for the upper lash). For instance, the lower lengthwise side can be formed to recreate the curve of the eyelid from the front of the eyelid to the part of the eyelid adjacent to the wet line. The artificial hairs can protrude from the lengthwise side as if the artificial hairs were protruding at the lash line (e.g., the recreated or prosthetic lash line).

In some embodiments, prosthetic eyelashes 602A can have a curve 606 that extends along a lengthwise side of the base 604. In some embodiments, the curve 606 that extends along a lengthwise side of the base of prosthetic eyelashes 602 can be different from a curve (e.g., curve 206 of prosthetic eyelashes 202A) of prosthetic eyelashes that have a lash line portion. The difference in curves can be implemented to address the difference in curves between the lash line and the portion eyelid adjacent to the lash line.

In some embodiments, the eyelid portion 630A of prosthetic eyelashes 602A can include a colorant on a portion the front surface 610 of the eyelid portion 630A of prosthetic eyelashes 602A (e.g., similar as described with respect to FIG. 2E and/or FIG. 5B). In some embodiments, the colorant on a portion of the front surface 610 of the eyelid portion 630A of prosthetic eyelashes 602A can be a black or charcoal color or another color that emulates eyeliner. In some embodiments, the front surface 610 of the eyelid portion 630A includes an elongated shape having a colorant.

In some embodiments, any of the prosthetic eyelashes as described herein can include a monolithic structure (e.g., monolithic prosthetic eyelashes). For example, monolithic prosthetic eyelashes can have a structure where the artificial hairs and the base are a monolithic structure (e.g., carved, cast, or formed from a single material). The monolithic prosthetic eyelashes can have artificial hairs without a distinct root area and without a distinct portion of the shaft that is within the base. In some embodiments, the base is monolithic structure and the artificial hairs are attached to the monolithic base. In some embodiments, part or all of the monolithic prosthetic eyelashes can be formed using a three dimensional (3D) printing device that forms the monolithic prosthetic eyelashes using a single material. In some embodiments, monolithic prosthetic eyelashes can be colored at one or more external surfaces using one or more colorants. For example, the artificial hairs of the monolithic prosthetic eyelashes can be colored in an eyelash color and the front surface of the monolithic prosthetic eyelashes can be colored in a skin-tone color. In some embodiments, an adhesive layer can be added to the rear surface of the monolithic prosthetic eyelashes.

Figure 7:
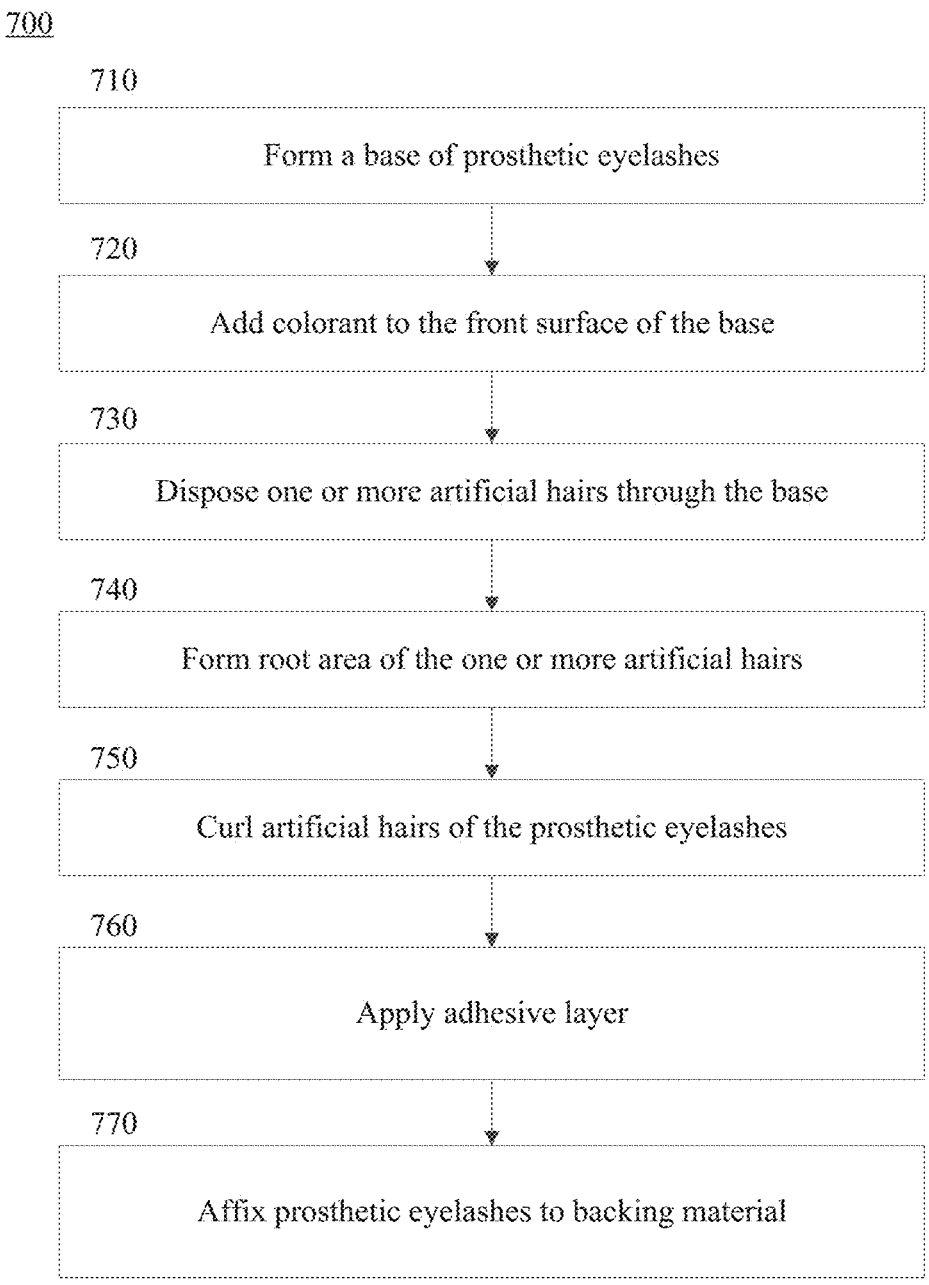
FIG. 7 illustrates a method of manufacturing prosthetic eyelashes, in accordance with some embodiments of the disclosure.
Figure 8:
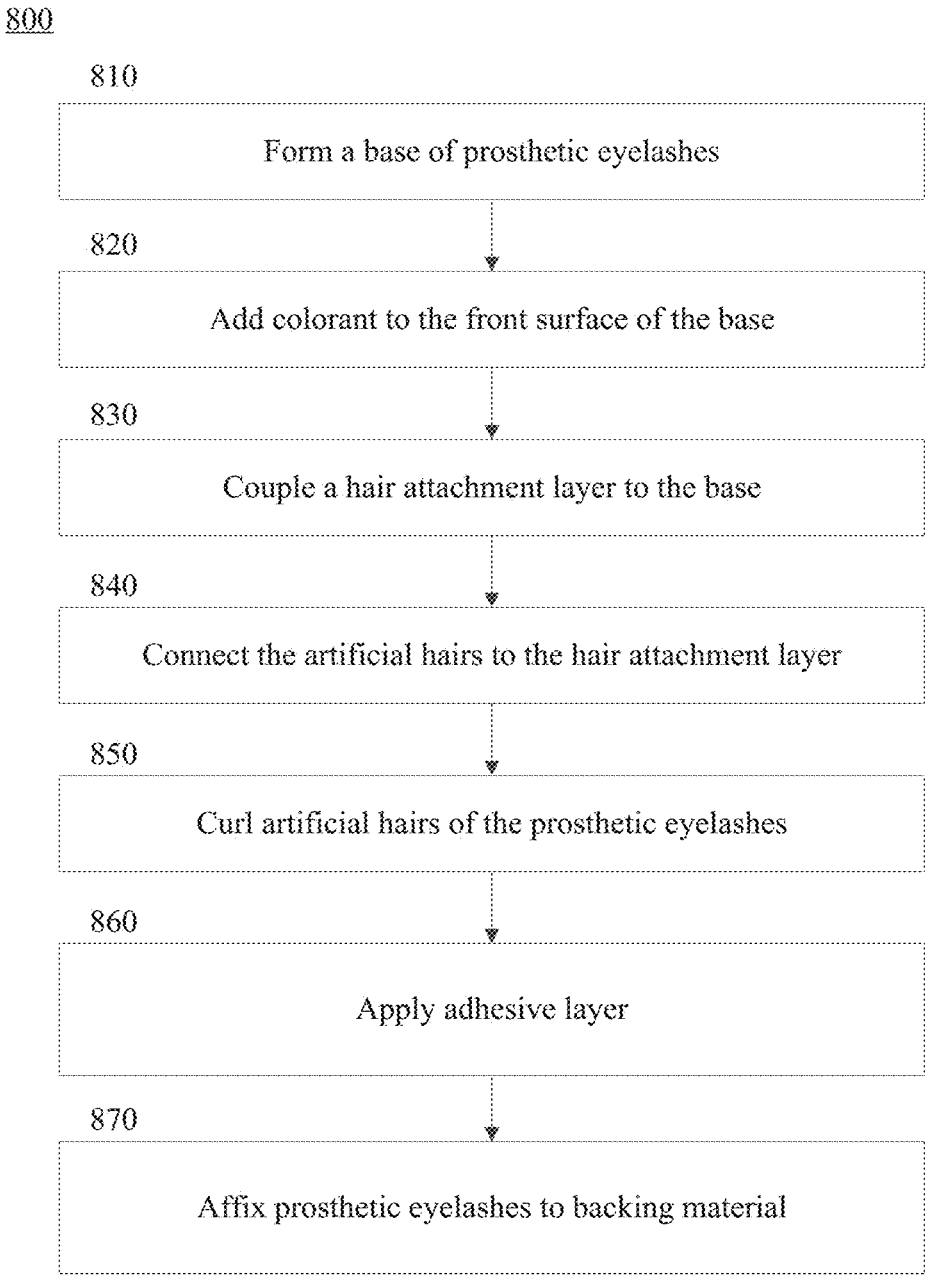
FIG. 8 illustrates a method of manufacturing prosthetic eyelashes using a hair attachment layer, in accordance with some embodiments of the disclosure.

Method 700 of FIG. 7 and method 800 of FIG. 8 can be performed by one or more pieces of manufacturing equipment or tools, collectively referred to as manufacturing equipment herein. Method 900 of FIG. 9 can be performed by a user applying prosthetic eyelashes. The user of method 900 can be the same user to whom the prosthetic eyelashes are applied or another user that applies the prosthetic eyelashes on behalf of the user. Method 700, 800 and 900 are described as a series of operations. It should be understood that some operations can be performed concurrently with other operations. In some embodiments, the same, fewer or greater number of operations can be performed in the same or different order. In some embodiments, different operations can be performed or the multiple operations can be combined in a single operation, or a single operation can be performed using multiple operations.

FIG. 7 illustrates a method of manufacturing prosthetic eyelashes, in accordance with some embodiments of the disclosure.

At operation 710, manufacturing equipment performing method 700 forms one or more bases of the prosthetic eyelashes. In some embodiments, the base material can be disposed into molds in the shape of bases of one or more prosthetic eyelashes. In some embodiments, the molds for prosthetic eyelashes for the upper lash are different from the molds for prosthetic eyelashes of the lower lash. In some embodiments, the molds for the prosthetic eyelashes for the right lashes are different from the molds for the prosthetic eyelashes of the left lashes. The shape of the prosthetic eyelashes for the upper lash can be different than the shape of prosthetic eyelashes for the lower lash. In some embodiments, the flexible and/or elastic material can be dispensed as a liquid or semi-liquid material. The base material can be cured by a curing process such as a heat cure or chemical cure so that the base material becomes solid.

At operation 720, manufacturing equipment adds colorant to the front surface of the base of the prosthetic eyelashes. In some embodiments, the front surface of the prosthetic eyelashes can be colored by a skin-tone colorant. In some embodiments, the front surface of the prosthetic eyelashes can also be colored at the eyelid portion of the prosthetic eyelashes with a dark colorant to make the prosthetic eyelashes appear to have eye liner or some other cosmetic or natural feature. In some embodiments, to form the pattern of colorant on the eyelid portion of the prosthetic eyelashes, a stencil can be used that protects other portions of the prosthetic eyelashes (e.g., the lash line portion of the prosthetic eyelashes) from exposure to the colorant. In some embodiments, the base material may be mixed with a colorant such that base is formed with the desired color at operation 710.

At operation 730, manufacturing equipment disposes one or more artificial hairs through the base. In one embodiments, the one or more artificial hairs are threaded through the base. For example, using a needle an artificial hair can either be threaded from the front side to the backside of the base or from the backside to the front side of the base.

At operation 740, manufacturing equipment forms the root area of one or more artificial hairs. In some embodiments, one or more knots can be implemented to form the root area of the artificial hairs. The knots can be formed at the rear surface of the base. In some embodiments, the root area can be formed by an application of heat. In some embodiments, the root area can be formed by a concurrent application of heat and pressure to artificial hairs at the rear of the prosthetic eyelashes. The application of heat (and is some cases pressure) can deform the artificial hairs so the root area is larger in diameter than the shaft and cannot be easily pulled through the base from the front side. In some embodiments, the root area can be formed by an application of adhesive at the proximal end of the artificial hair. In some embodiments, the root area can be formed by a combination of two or more of an application knots, heat, pressure or adhesive. In some embodiments, the no additional process is used to form the root. For instance, the artificial hair can be threaded through the base and cut with no additional operation to create a distinct root area. In such instances, the root area can be considered the proximal end area of the artificial hair.

In some embodiments and as noted above, the artificial hairs can be directly sewn or woven into the base without a hair attachment layer. The artificial hairs can be secured to the base in accordance with embodiments disclosed herein. For example, the artificial hairs can be threaded through the base and knotted at the proximal ends. For instance, a single artificial hair can be threaded from the rear surface of the base and out the front surface of the base. The single artificial hair that is threaded through the base can displace the base around the artificial hair to form a follicle area. The single artificial hair can be knotted at the proximal end (e.g., nearest the rear surface of the base) to secure the artificial hair to the base.

It can be noted that in some embodiments, the root areas of the artificial hairs can be formed prior to disposing the one or more artificial hairs through or in the base. The artificial hairs with the root area can be threaded through from the backside to the front side of the base until the root area abuts the rear surface of the base.

In some embodiments, the artificial hairs with a preformed root area can be arranged in a stencil or other apparatus, such as a mold. The base material can be disposed around the one or more artificial hairs. The root areas of the one or more artificial hairs can be fully or partially encased by the base material.

At operation 750, manufacturing equipment can curl the artificial hairs of the prosthetic eyelashes. In some embodiments, the artificial hairs of prosthetic eyelashes can be wrapped around a cylindrical tool, such as a dowel, and secured to the cylindrical tool. The prosthetic eyelashes including the artificial lashes can be exposed to a heat source, such as an oven, which can cause the artificial hairs to deform to the desired curl. In some embodiments, the artificial hairs of the prosthetic eyelashes can be curled prior to disposing the artificial hairs through the base.

At operation 760, an adhesive layer is applied to the rear surface of the prosthetic eyelashes. At operation 770, the prosthetic eyelashes are affixed to a backing material. For example, the rear surface (with or without an adhesive layer) of the prosthetic eyelashes can adhere to the backing material. The prosthetic eyelashes can be releasably coupled to the backing material.

FIG. 8 illustrates a method of manufacturing prosthetic eyelashes using a hair attachment layer, in accordance with some embodiments of the disclosure.

At operation 810, manufacturing equipment performing method 800 forms one or more bases of the prosthetic eyelashes. Operation 810 is similar to operation 710 and the description of operation 710 can apply to operation 810 and is not repeated for the sake of brevity.

At operation 820, manufacturing equipment adds colorant to the front surface of the base of the prosthetic eyelashes. Operation 820 is similar to operation 720 and the description of operation 720 can apply to operation 820 and is not repeated for the sake of brevity.

At operation 830, manufacturing equipment couples a hair attachment layer to the base. In some embodiments, the hair attachment layer can be coupled to the rear surface of the base. In some embodiments, an adhesive can be used to couple the hair attachment layer to the base. In some embodiments, the hair attachment layer can be placed on the rear surface of the base without an adhesive. In some embodiments, the hair attachment layer can be coupled to the base while performing operation 840 or caused by the performance of operation 840.

At operation 840, manufacturing equipment connects the artificial hairs to the hair attachment layer. In some embodiments, the artificial hairs can be woven through the front side of the base to the backside of the base and through the hair attachment layer. The artificial hairs can be attached to hair attachment layer using one or more sewing or knotting techniques (e.g., to form the root area of the artificial hairs). In other embodiments, the artificial hairs can be woven from the backside of the base through to the front side of the base and coupled to the hair attachment layer using one or more sewing or knitting techniques. In some embodiments, other techniques to attach the artificial hairs to the hair attachment layer can be implemented, including but not limited to the application of heat to connect the artificial hairs to the hair attachment layer.

It can be noted that in some embodiments, the artificial hairs can be coupled to the hair attachment layer using one or more sewing or knotting techniques prior to forming the base. The hairs coupled to the hair attachment layer can be arranged in a stencil or other apparatus, such as a mold. The base material can be disposed around the one or more artificial hairs and the hair attachment layer. In some embodiments, the hair attachment layer and in some embodiments, the root areas of the one or more artificial hairs, can be fully or partially encased by the base material.

At operation 850, manufacturing equipment can curl the artificial hairs of the prosthetic eyelashes. Operation 850 is similar to operation 750 and the description of operation 750 can apply to operation 850 and is not repeated for the sake of brevity.

At operation 860, an adhesive layer is applied to the rear surface of the prosthetic eyelashes. At operation 870, the prosthetic eyelashes are affixed to a backing material. For example, the rear surface (with or without an adhesive layer) of the prosthetic eyelashes can adhere to the backing material. The prosthetic eyelashes can be releasably coupled to the backing material.

Figure 9:
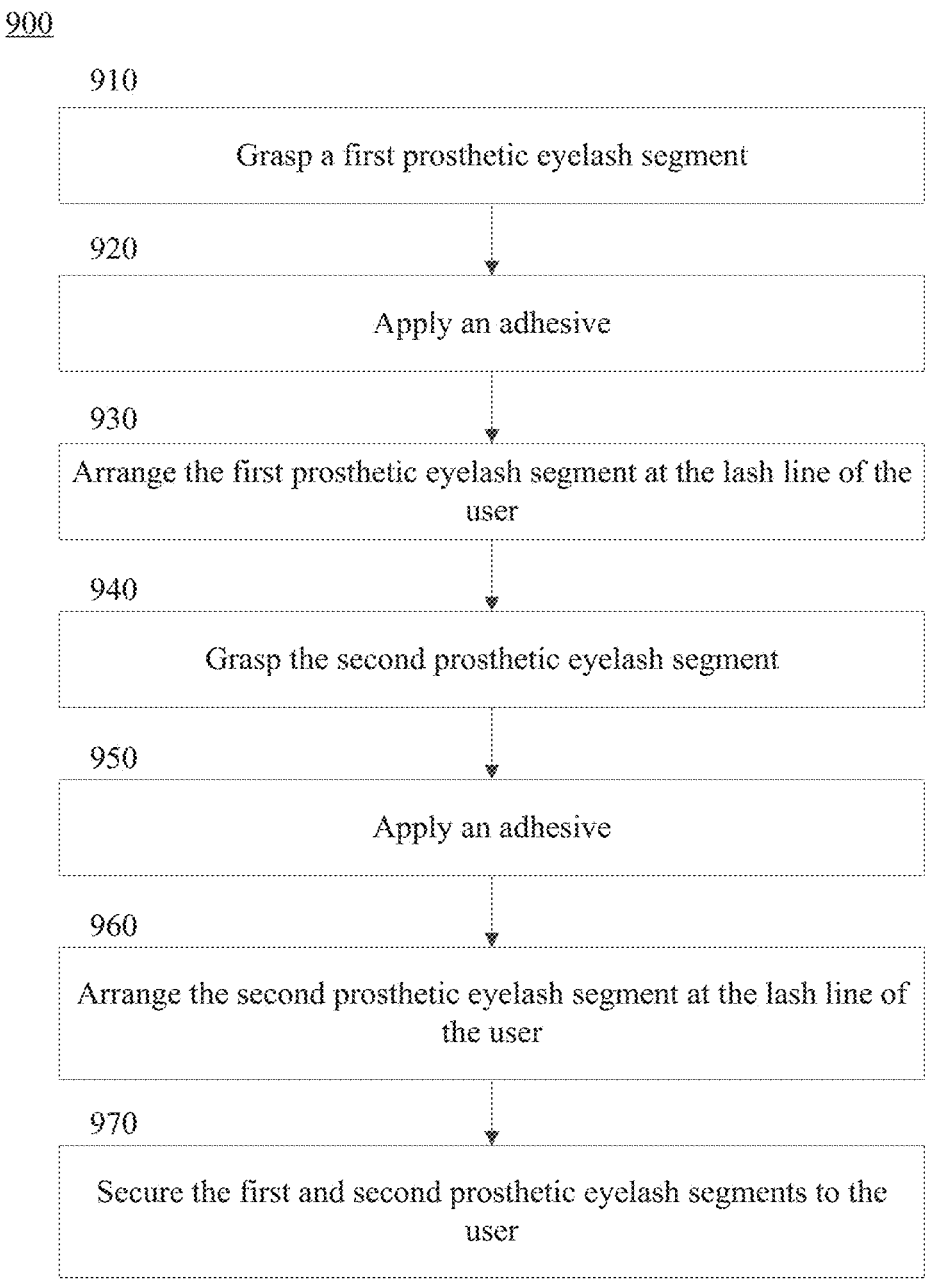
FIG. 9 is a method of applying prosthetic eyelashes, in accordance with some embodiments.

FIG. 9 is a method of applying prosthetic eyelashes, in accordance with some embodiments.

At operation 910, the user grasps a first prosthetic eyelash segment. In some embodiments, the user removes the first prosthetic eyelash segment from the backing material. In some embodiments, the user grasps the first prosthetic eyelash segment with their hands. In other embodiments, the user grasps the first prosthetic eyelash segment with an applicator tool.

At operation 920, the user applies an adhesive. In some embodiments, the adhesive can be applied to the rear surface of the prosthetic eyelash unit. In some embodiments, the adhesive can be applied to the eye area, such as the lash line, a portion of the eyelid adjacent to the lash line, or both. In some embodiments, the prosthetic eyelash segment may have an adhesive layer pre-applied to the rear surface of the prosthetic eyelash segment. In such cases, an additional adhesive may or may not be applied.

At operation 930, the user arranges the first prosthetic eyelash segment at the lash line of the user. In some embodiments, the user may use their hands. In some embodiments, the user may use an applicator tool.

At operation 940, the user grasps the second prosthetic eyelash segment. Operation 940 is similar to operation 910 and the description of operation 910 can apply to operation 940 and is not repeated for the sake of brevity.

At operation 950, the user applies an adhesive. Operation 950 is similar to operation 920 and the description of operation 920 can apply to operation 950 and is not repeated for the sake of brevity.

At operation 960, the user arranges the second prosthetic eyelash segment at the lash line of the user. The second prosthetic eyelash segment can be arranged adjacent to (e.g., directly adjacent to) the first prosthetic eyelash segment. Operation 960 is similar to operation 930 and the description of operation 930 can apply to operation 960 and is not repeated for the sake of brevity. It can be noted that in some embodiments one or more (additional) prosthetic eyelash segments can be arranged in a similar manner as described herein.

At operation 970, the user secures the first and second prosthetic eyelash segments to the user. In some embodiments, an additional application of pressure or heat can secure (e.g., bond) the first and second prosthetic eyelash segments to the user. In some embodiments, the user can use their hands to secure the first and second prosthetic eyelash segments. In some embodiments, the user can use an applicator tool to secure the prosthetic eyelash segments. In some embodiments, the first and second prosthetic eyelash segments can be secured concurrently. In some embodiments, the first and second prosthetic eyelash segments can be secured at different times. For example, the first prosthetic eyelash segment can be secured (e.g., immediately) after arranging the first prosthetic eyelash segment at the eye area of the user. The second prosthetic eyelash segment can be secured (e.g., immediately) after arranging the second prosthetic eyelash segment at the eye area of the user.

In some embodiments, the user can apply artificial lash extensions to the prosthetic eyelashes subsequent to affixing the prosthetic eyelashes to the user. In some embodiments, the user can apply cosmetics to the secured prosthetic eyelash segments of the prosthetic eyelash unit.

Figure 10:
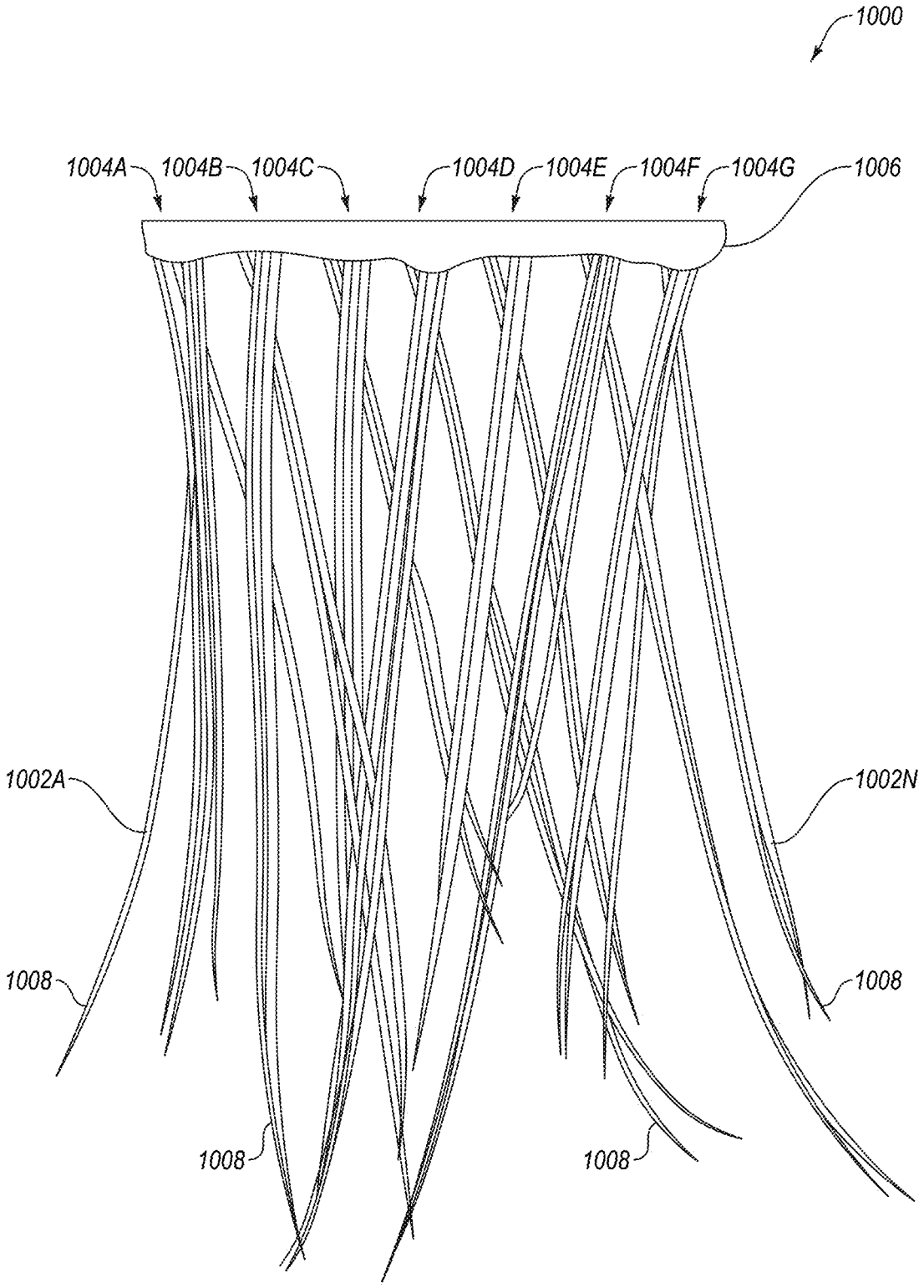
FIG. 10 is an illustration of an exemplary artificial lash extension, in accordance with some embodiments of the disclosure.

FIG. 10 is an illustration of an exemplary artificial lash extension, in accordance with some embodiments of the disclosure.

In some embodiments, one or more of artificial lash extension 1000 (also referred to as "lash extension," "artificial eyelash extension," "lash segment" or "artificial lash segment" herein) are designed or configured for application at the underside of a natural lash. In some embodiments, artificial lash extension 1000 can be part of a set of multiple artificial lash extensions. In some embodiments, artificial lash extension 1000 can be a segment of a "full" artificial lash extension such that when multiple artificial lash extensions are arranged adjacent to one another at the underside of a natural lash (e.g., natural lashes 102A) or underside of prosthetic eyelashes (e.g., underside of the artificial hairs of prosthetic eyelashes) the arranged artificial lash extensions span the length of the natural lash. The artificial lash extensions can be arranged to substantially align with the lash line of the user. Using artificial lash extensions that are independent segments can allow an individual artificial lash extension to move independently when bonded to the underside of a natural lash or underside of a prosthetic eyelashes, which mimics the movement of the natural lash and can improve the feel, comfort, and longevity of the artificial lash extensions.

Artificial lash extension 1000 depict artificial hairs 1002A-1002N (collectively referred to as "artificial hairs 1002" herein). In some embodiments, the artificial hairs of an artificial lash extension, such as artificial lash extension 1000, can be formed from one or more synthetic materials, including but not limited to polybutylene terephthalate (PBT), acrylic resin, polyester (e.g., polyethylene terephthalate (PET)), or other synthetic material. In alternative embodiments, a natural material such as natural hair (e.g., human hair or mink hair) can be used. In some embodiments, the artificial hairs of a particular artificial lash extension can have one or more lengths and/or one or more diameters. In some embodiments, the diameter of an artificial hair can be between approximately 0.0075 millimeters (mm) (e.g., 0.0075 mm+/−0.0025 mm) to 0.3 mm (e.g., 0.3 mm+/−0.05 mm). In some embodiments, the ends of one or more of the artificial hairs can be tapered. In some embodiments, the one or more of artificial hairs can be curled or shaped in particular direction. For example, the ends 1008 of artificial hairs 1002 can be tapered or curled or both. In some embodiments, the artificial hairs can range from 3 mm to 30 mm in length or in some instances even longer.

In some embodiments, artificial lash extension 1000 can include a base, such as base 1006. The base can include a top side (e.g., facing out of the page and towards the reader), a bottom side, a back side, a front side, and two lateral sides. In some embodiments, one or more of the multiple artificial hairs of artificial lash extension protrude out the front side of the base. When arranged at the underside of a natural lash or underside of prosthetic eyelashes, the backside of the artificial lash extension can point towards the user's eye. The thickness (e.g., between the topside and bottom side of the base can be between approximately 0.05 millimeters (mm) and approximately 0.15 mm (e.g., 0.05 mm+/−0.01 mm). The low profile of the base is designed to allow the artificial lash extension to be light weight so as to better adhere to the underside of the natural lash or underside prosthetic eyelashes and prevent obstruction of a user's view. The low profile of the base can at least in part be attributed to an application of heat in the formation of the base.

In some embodiments, one or more of the top side or bottom side (e.g., surface) of the base is substantially flat (e.g., having a flatness control tolerance value of +/−0.03 mm or +/−0.015 mm). In some embodiments, the flatness of the base of the artificial lash extension 1000 is designed to allow improved contact and adhesion to a surface, such as the underside of a natural lash, underside of prosthetic eyelashes or the opposing surface of another artificial lash extension. The flatness of the base can at least in part be attributed to an application of heat in the formation of the base.

In some embodiments, the base can be formed by an application of heat at or near the area of the base to be formed. The application of heat can cause one or more of the artificial hairs (e.g. all of the artificial hairs) of an artificial lash extension to be connected to or at the base. In some embodiments, a heated fixture, such a heated platen, a heated crimp, heating lamp or other device (e.g. heat source) can be used (e.g., pressed against the artificial hairs) to cause the artificial hairs to at least become soft, tacky or sticky (e.g., at least partially melt). In some embodiments, the at least partially melted or deformed artificial hairs at least in part, or in full, form the base. In some embodiments, the at least partially melted artificial hairs melt change in manner that connects the multiple artificial hairs to or at the base of the artificial lash extension. In some embodiments, to at least partially melt the artificial hairs at the base area the artificial hairs can be heated to a temperature between 55-100 degrees Celsius, which can cause the artificial hairs to be connected at or to the base. In some embodiments, the application of heat is at a temperature, above, within or at the glass transition temperature of the material of the artificial hairs. At the glass transition temperature the material of the artificial hairs transitions from brittle to a softer, rubbery, tacky or pliable state. In some embodiments, the application of heat is at a temperature above, within or at the melt temperature of the material of the artificial hairs. For example, the base area (and/or other parts of the artificial lash extension) can be heated above 200 degrees Celsius.

In some embodiments, some additional artificial material, such as one or more artificial hairs or other material(s) can be placed orthogonal to the artificial hairs at the area where the base is to be formed. Heat can be applied to the area of where the base is to be formed (which includes the additional artificial material). One or more of the artificial hairs or the additional artificial material can at least partially melt to at least in part, or in full, form the base. In some embodiments, the additional artificial material can include an adhesive (e.g. application of adhesive) and/or support thread. In some embodiments, the application of heat can be used to help cure the applied adhesive. In some embodiments that use an adhesive with the application of heat may or may not partially melt the artificial hairs.

In some embodiments, prior to the application of heat the artificial hairs may be tied (e.g., knotted) to a support or base thread or fiber to align the artificial hairs and prevent the horizontal spreading of the artificial hairs. Heat can be applied as described above (while the artificial hairs are knotted to a support thread) such that the support thread forms part of the base. In other instances, heat can be applied below the horizontal support thread. For instance, the support thread can hold the artificial hairs in place and the application heat can form a base below the support thread. In other embodiments, the artificial hairs are not aligned with a support thread (e.g., are not knotted on a support thread) before or during the formation of the base using the application of heat. In other embodiments, the artificial hairs can be arranged using a stencil or other arrangement device before or during the formation of the base using the application of heat. In some embodiments, one or more applications of heat can be performed to form the base. In an alternative embodiment, the base can be formed in part or in full using a chemical process.

In some embodiments, artificial lash extension 1000 include artificial hairs 1002 that are configured into clusters 1004A-1004G (collectively referred to as "clusters 1004" herein). In some embodiments, a cluster of hairs can refer to two or more artificial hairs that are grouped together. In some embodiments, 2-30 artificial hairs can be included in a cluster. In some embodiments, one or more individual clusters of artificial hairs can be formed using an application of heat as described above. Thus, the clusters can have a base (e.g., cluster base). The clusters can be arranged and heat can be applied, as described above, to the cluster bases to form another base (e.g., artificial lash extension base). In some embodiments, the artificial lash extension is formed without creating clusters using the application of heat. In some embodiments, at least two artificial hairs of an artificial lash extension crisscross each other. For example, two artificial hairs of a particular cluster can crisscross one another.

In some embodiments, artificial lash extension 1000 may be 4-10 mm wide, though embodiments may be 5-6 mm wide. In some embodiments, this is much wider than single clusters that are typically 1.5-2 mm wide, and thus provide greater coverage of the natural lash.

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Reference throughout this specification to "one embodiment," "certain embodiments," "one or more embodiments," "some embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment," "some embodiments" or "in an embodiment" in various places throughout this specification are not necessarily referring to the same embodiment of the invention. Furthermore, the particular features, structures, materials, or characteristics may be combined in any suitable manner in one or more embodiments.

The terms "connected," "coupled," or any variant thereof includes any connection or coupling between two or more elements, either direct or indirect.

As used herein, the singular forms "a," "an," and "the" include plural references unless the context clearly indicates otherwise. Thus, for example, reference to "an element" includes a single element as well as two or more different elements. The words "example" or "exemplary" are used herein to mean serving as an example, instance, or illustration. Any aspect or design described herein as "example' or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or." That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances.

What is claimed is:

1. A prosthetic eyelash unit, comprising:

a base comprising a front surface, a rear surface opposite the front surface, and a plurality of follicle areas located within the base, wherein the base is a monolithic structure;

a plurality of artificial hairs extending from the plurality of follicle areas located within the base and through the front surface of the base, wherein at least a portion of the rear surface of the base is designed to bend between an upper lengthwise side of the base and a lower lengthwise side of the base to form a curvature, wherein the curvature attaches to and at least in part covers one or more natural hair follicles of a lash line of a user to form a prosthetic lash line; and a hair attachment layer to which the plurality of artificial hairs are woven.

2. The prosthetic eyelash unit of claim 1, wherein the base is further configured to bend to form another curvature that extends along a lengthwise side of the base, and wherein the base is formed at least in part of a flexible material.

3. The prosthetic eyelash unit of claim 2, wherein the flexible material of the base is a first material, the prosthetic eyelash unit further comprising:

the hair attachment layer comprising a second material different than the first material.

4. The prosthetic eyelash unit of claim 3, wherein the hair attachment layer is embedded within the flexible material of the base.

5. The prosthetic eyelash unit of claim 3, wherein the hair attachment layer is attached at the rear surface of the base.

6. The prosthetic eyelash unit of claim 2, wherein the flexible material of the base comprises silicone.

7. The prosthetic eyelash unit of claim 1, wherein the plurality of follicle areas are positioned at different locations along the base, and wherein one to three artificial hairs of the plurality of artificial hairs extend from each of the plurality of follicle areas.

8. The prosthetic eyelash unit of claim 1, further comprising:

a plurality of prosthetic eyelash segments each comprising the base and the plurality of artificial hairs, the prosthetic eyelash segments designed to align adjacent to one another at the lash line of the user.

9. The prosthetic eyelash unit of claim 1, the base further comprising:

a lash line portion comprising the plurality of artificial hairs and designed to attach to the lash line of the user.

10. The prosthetic eyelash unit of claim 9, the base further comprising:

an eyelid portion monolithically coupled with the lash line portion, the eyelid portion designed to attach to a front surface of an eyelid of the user.

11. The prosthetic eyelash unit of claim 1, wherein the front surface of the base comprises an elongated shape defined by a colorant, the elongated shape configured to resemble eyeliner.

12. The prosthetic eyelash unit of claim 1, wherein an artificial hair of the plurality of artificial hairs comprises:

a shaft; and a root area connected to the shaft, the root area to secure the artificial hair to the base.

13. The prosthetic eyelash unit of claim 12, wherein the root area of the artificial hair is located within the base or at the rear surface of the base.

14. The prosthetic eyelash unit of claim 1, further comprising:

an adhesive layer coupled to the rear surface of the base.

15. The prosthetic eyelash unit of claim 14, wherein the adhesive layer comprises a moisturizing component to moisturize skin at the lash line.

16. The prosthetic eyelash unit of claim 1, wherein the lash line of the user is an upper lash line.

17. The prosthetic eyelash unit of claim 1, wherein the lash line of the user is a lower lash line.

18. The prosthetic eyelash unit of claim 1, wherein at least part of the front surface of the base comprises a skin-tone colorant.

19. The prosthetic eyelash unit of claim 1, wherein a depth of the base ranges between 0.1 millimeters to 0.9 millimeters.

20. The prosthetic eyelash unit of claim 1, wherein the plurality of artificial hairs are attached to the base by an attachment process that pulls each of the plurality of artificial hairs through the base.

* * * * *